US005608809A

United States Patent [19]

Ueda

[11] Patent Number: 5,608,809

[45] Date of Patent: Mar. 4, 1997

[54] LOUDSPEAKER MOUNTING APPARATUS

[75] Inventor: Mitsugu Ueda, Nagaokakyo, Japan

[73] Assignees: Mitsubishi Denki Kabushiki Kaisha; Mitsubishi Electric Engineering Co., Ltd., both of Tokyo, Japan

[21] Appl. No.: 355,237

[22] Filed: Dec. 9, 1994

[30] Foreign Application Priority Data

Feb. 9, 1994 [JP] Japan ..... 6-015429

[51] Int. Cl.[6] ..... H04R 25/00

[52] U.S. Cl. ..... 381/188; 381/205; 181/199

[58] Field of Search ..... 381/24, 88, 89, 381/90, 182, 186, 188, 152, 205; 181/199, 150

[56] References Cited

U.S. PATENT DOCUMENTS 4,453,047 6/1984 Thompson ..... 381/205

4,672,675 6/1987 Powell et al. ..... 381/205

FOREIGN PATENT DOCUMENTS 2937750 4/1981 Germany ..... 381/205

60-43995 3/1985 Japan .

61-97290 6/1986 Japan .

62-191283 12/1987 Japan .

*Primary Examiner*—Curtis Kuntz

*Assistant Examiner*—Huyen D. Le

[57] ABSTRACT

A loudspeaker mounting apparatus has a configuration in which frame-parts each having a groove for fitting with a flange of a loudspeaker to be mounted are hinged at one end. By connecting the other ends of the frame-parts, the loudspeaker is fixed on the loudspeaker mounting apparatus and can be mounted at a position.

12 Claims, 41 Drawing Sheets

LOUDSPEAKER MOUNTING APPARATUS

BACKGROUND OF THE INVENTION

1. Field of the Invention

The present invention relates to an apparatus for mounting a loudspeaker on the body of a television set, a radio or the like.

2. Description of Related Art

FIG. 1 is a front view of a television set having a cabinet 50. A cathode-ray tube (CRT) 55 is provided approximately at the center of the cabinet 50, and longitudinally extending speaker grilles 53 are disposed on the both sides of the cabinet 50. On the back face of each of the speaker grilles 53 is disposed a loudspeaker by using a loudspeaker mounting apparatus described below.

FIG. 2 is a plan sectional view of the television set taken on line I—I of FIG. 1, and shows the loudspeaker mounting apparatus conventionally in use. FIG. 3 is a plan view of the conventional loudspeaker mounting apparatus of FIG. 2, and FIG. 4 is a front view thereof. As shown in FIG. 2, the loudspeaker grille 53 provided with bosses 51 for receiving screws on the back face. A loudspeaker mounting apparatus 71 is disposed between the CFR 55 and the side wall of the cabinet 50. The loudspeaker mounting apparatus 71 has a shape of a hollow right triangular prism that is solid molded by injection molding. The loudspeaker mounting apparatus 71 is positioned so that the face along the hypotenuse opposes the side wall of the cabinet 50 and the face along the shorter orthogonal side opposes the bosses 51 to be screwed onto the bosses 51.

As is shown in FIG. 3, the loudspeaker mounting apparatus 71 is in the shape of approximately a right angled triangle when planarly seen. The face along the shorter orthogonal side is approximately in the shape of a rectangular vertically extending as shown in FIG. 4, and has an ellipse opening 73 also vertically extending. The face along the shorter orthogonal side of the loudspeaker mounting apparatus 71 is longer than the face along the longer orthogonal side, and is provided with holes 74 at the corners thereof so as to oppose the bosses 51 for receiving screws (shown in FIG. 2).

FIG. 5 is a front view of the face along the hypotenuse in the conventional loudspeaker mounting apparatus 71 of FIG. 2. This face is approximately in the shape of a square and has a circular opening 75 at the center. This face is also longer than the face along the longer orthogonal side of the loudspeaker mounting apparatus 71. Bosses 72 for screwing a loudspeaker 25 thereon are disposed at four corners on the back face of this face and holes 76 are disposed at the corners so as to be respectively communicated with the bosses 72 provided at the corners thereof.

The edge of the opening 75 provided in the face along the hypotenuse in the loudspeaker mounting apparatus 71 is in contact with a flange 26 of a loudspeaker 25. The loudspeaker 25 is fixed on the loudspeaker mounting apparatus 71 by screwing screws 61 inserted through holes provided on the flange 26 into the bosses 72. The loudspeaker mounting apparatus 71 mounting the loudspeaker in this manner is then fixed on the cabinet 50 by screwing screws 60 inserted through the holes 74 on the face along the shorter orthogonal side into the bosses 51 for screws.

In such a conventional loudspeaker mounting apparatus, the loudspeaker is fixed by using the screws as described above. Accordingly, a great number of components and a long time of labor are required. Further, since the loudspeaker mounting apparatus in the shape of approximately a hollow right triangular prism is solid molded by the injection molding, a mold for the molding has a complicated structure, resulting in a high cost.

SUMMARY OF THE INVENTION

The present invention is devised to solve the above-mentioned problems, and the objective thereof is provide a loudspeaker mounting apparatus that requires a short time of labor and a low production cost.

The loudspeaker mounting apparatus of the invention comprises a pair of frame-parts each having a groove at inside thereof for fitting with a flange of a loudspeaker to be mounted, and the groove is in the shape of an arc of a circle corresponding to said flange. The frame-parts are hinged at one end and connectable with each other at the other end.

Accordingly, while rotating the frame-parts with the hinge as a pivot, the flange of the loudspeaker is inserted into the grooves formed at inside of the frame-parts, thereby connecting the frame-parts with each other. Thus, the loudspeaker is fixed with ease without using any screws.

Alternatively, the loudspeaker mounting apparatus comprises a pair of frame-parts each including a fixing portion having a groove at inside of each of the frame-parts for fitting with a flange of a loudspeaker to be mounted, and the groove is in the shape of an arc of a circle corresponding to the flange. The frame-parts are hinged with a first hinge at one end and the other end is provided with a connecting portion.

Accordingly, while .rotating the frame-parts with the first hinge as a pivot, the flange of the loudspeaker is inserted into the grooves in the fixing portions formed at inside of the frame-parts, which are then connected with each other with the connecting portion. Thus, the loudspeaker can be fixed with ease without using any screws.

In the loudspeaker mounting apparatus of the present invention, the fixing portion is plural in number and forms the frame-parts. Therefore, two-or more-way loudspeakers can be also fixed on the loudspeaker mounting apparatus without using any screws.

In the loudspeaker mounting apparatus of the present invention, each of the frame-parts is closed at one end, and the fixing portion is positioned at a predetermined distance away from the closed end. Therefore, when the frame-parts are connected with each other, the space behind the fixed loudspeaker is closed. Thus, the sound leakage into the body is prevented, resulting in improved sound quality.

In the loudspeaker mounting apparatus of the present invention, the fixing portion includes a plurality of second hinges each of which has a desired length and is disposed at an edge of the groove, and wedges each of which is disposed at a tip of each of the second hinges and has an appropriate width. Therefore, by bending the wedge inward with the second hinge as a pivot, a loudspeaker having a flange height smaller than the width of the groove can be fixed on the fixing portion.

In the loudspeaker mounting apparatus of the present invention, the fixing portion includes a plurality of holes formed at a bottom of the groove, thinner portions with a smaller thickness than the other portions each of which is formed at an edge of the groove at a position corresponding to each of the holes, and ribs each projecting from each of the thinner portion so as to face the groove and come in contact with the flange of the loudspeaker.

Thus, the thinner portions attain elasticity. Therefore, when the flange of a loudspeaker having a flange height smaller than the width of the groove is inserted into the groove in the fixing portion, the ribs provided on the face of the groove side of the thinner portions come in contact with the flange, thereby bending the thinner portions outward. Then, the flange of the loudspeaker is inserted into the groove, and is pressed against the fixing portion with the elasticity of the thinner portions. In this manner, various types of loudspeakers having different flange heights can be fixed on the loudspeaker mounting apparatus.

The above and further objects and features of the invention will more fully be apparent from the following detailed description with accompanying drawings.

DESCRIPTION OF PREFERRED EMBODIMENTS

The present invention will now be described referring to the accompanying drawings illustrating embodiments thereof.

Embodiment 1

Figure 1:
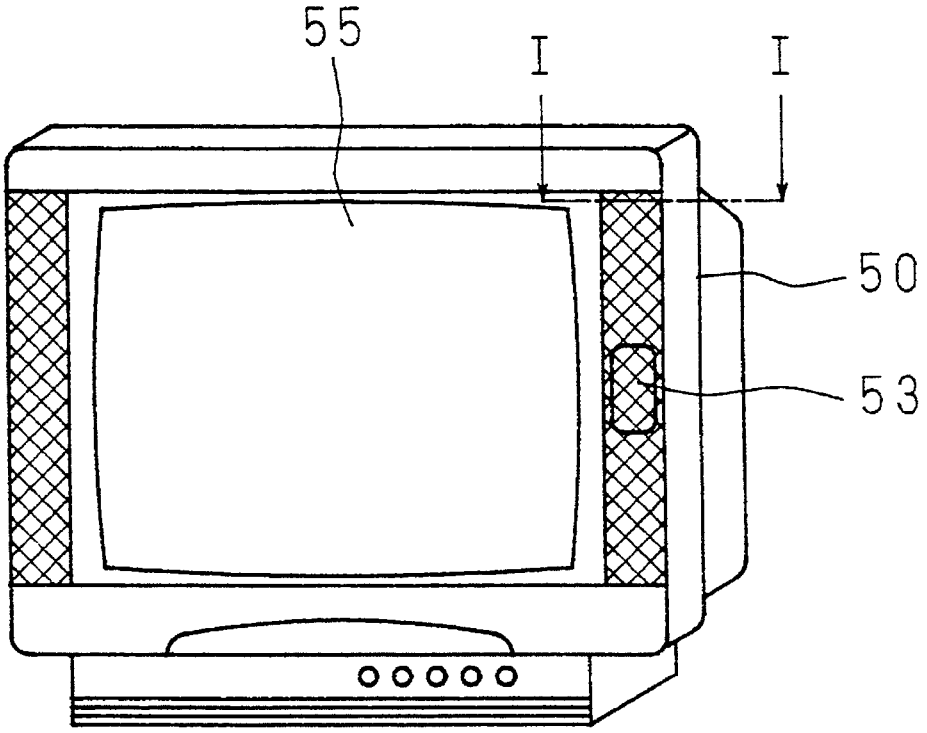
FIG. 1 PRIOR ART
FIG. 1 is a front view of a television set.
Figure 2:
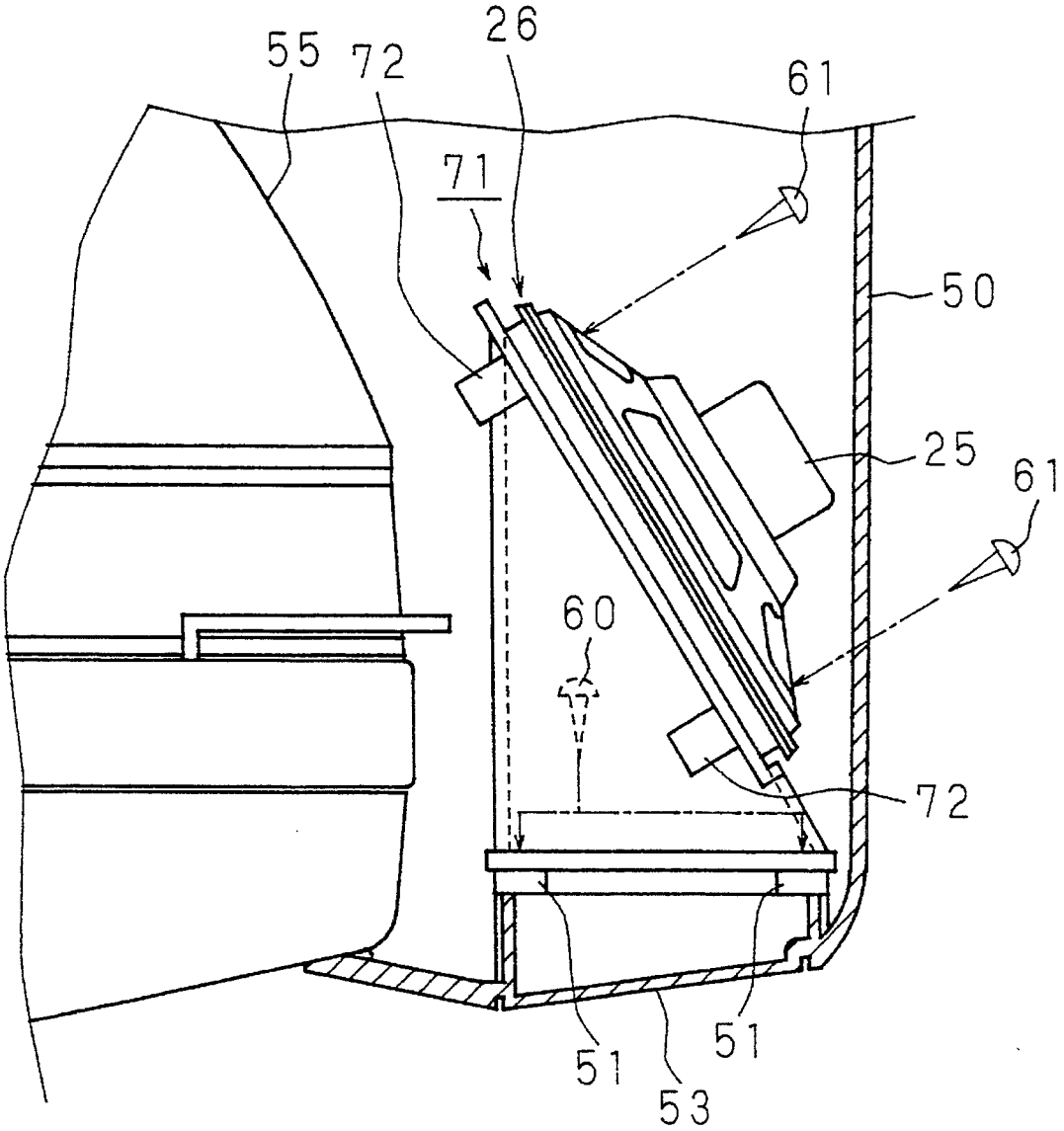
FIG. 2 PRIOR ART
FIG. 2 is a plan sectional view of the television set taken on line I—I of FIG. 1.
Figure 3:
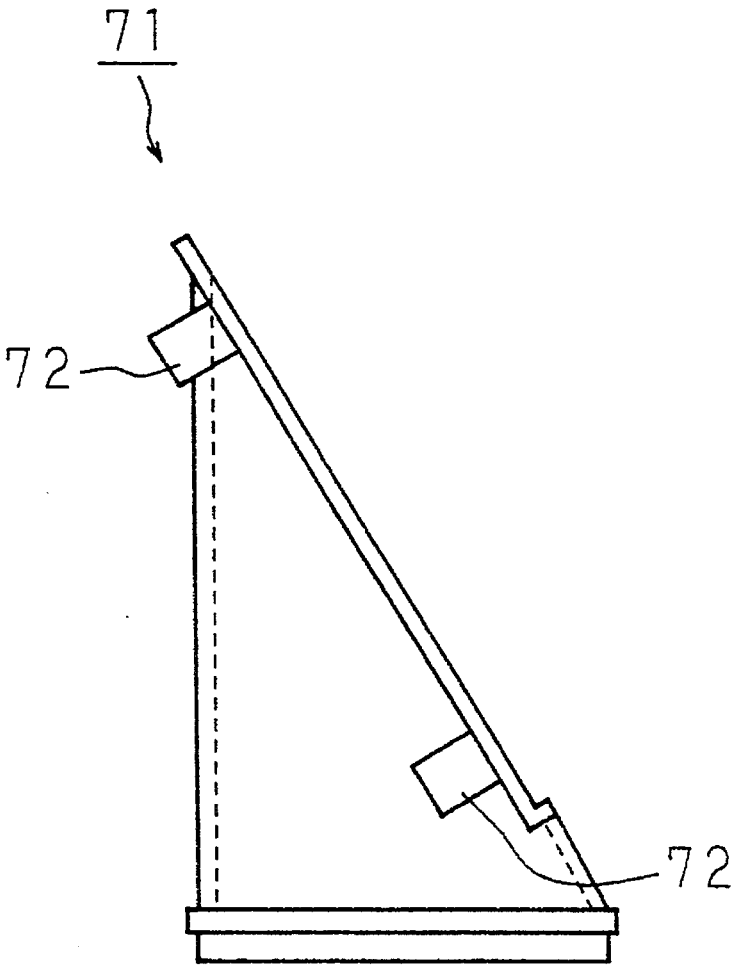
FIG. 3 PRIOR ART
FIG. 3 is a plan view of a conventional loudspeaker mounting apparatus in the television set of FIG. 2.
Figure 4:
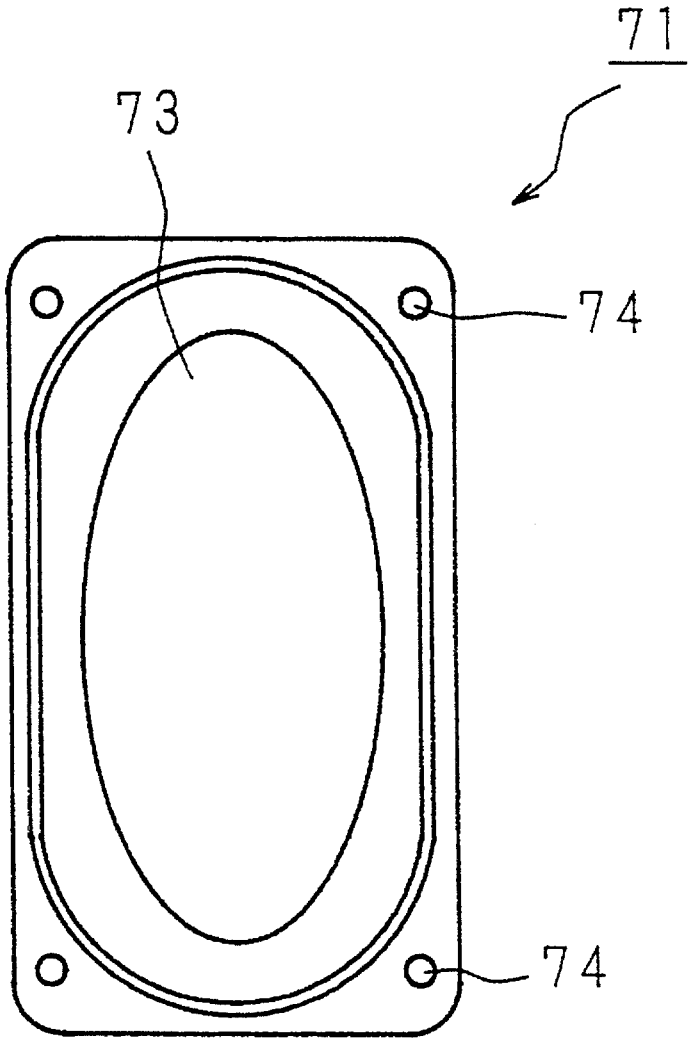
FIG. 4 PRIOR ART
FIG. 4 is a front view of the conventional loudspeaker mounting apparatus of FIG. 2.
Figure 5:
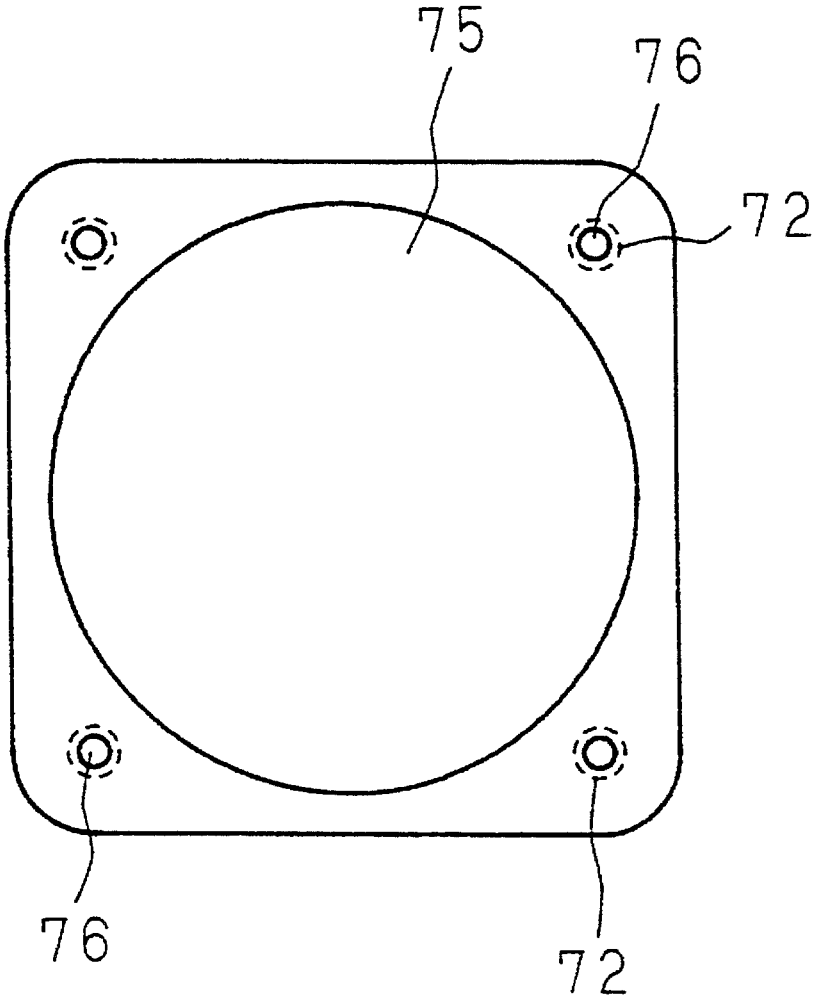
FIG. 5 PRIOR ART
FIG. 5 is a front view of the face along the hypotenuse in the conventional loudspeaker mounting apparatus of FIG. 2.
Figure 6:
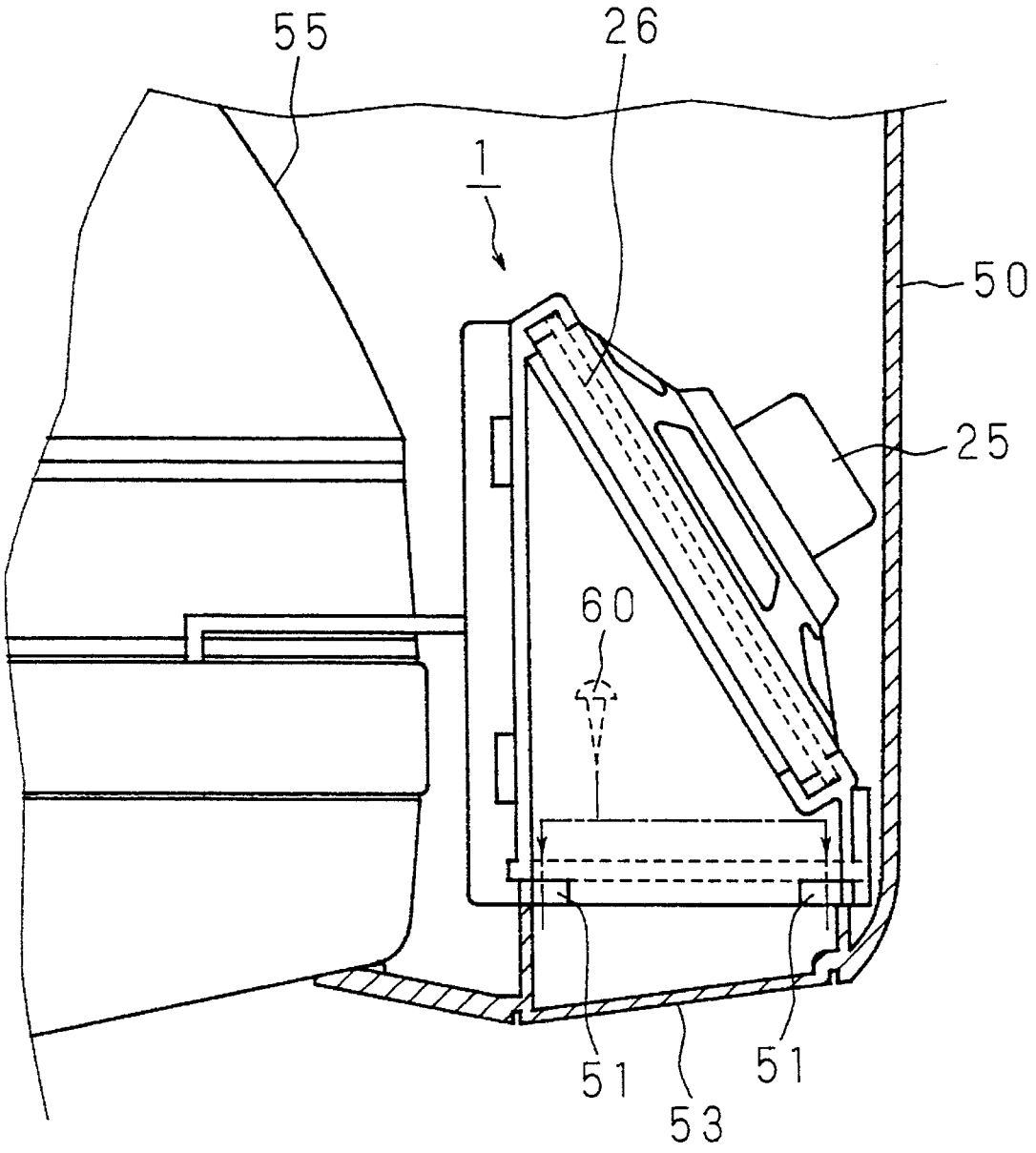
FIG. 6 is a partial plan sectional view of a television set including a loudspeaker mounting apparatus according to this invention.

FIG. 6 is a partial plan sectional view of a television set including a loudspeaker mounting apparatus of this invention, wherein a cabinet,, a loudspeaker grille and a CRT are indicated by reference numerals 50, 53 and 55, respectively. On the back face of both ends of the loudspeaker grille 53, bosses 51 for receiving screws are disposed at a predetermined height so as to be positioned at the four corners of a rectangle. Between the CRT 55 and the side wall of the cabinet 50 is disposed a loudspeaker mounting apparatus 1 on which a loudspeaker 25 is fixed so as to oppose the bosses 51. The loudspeaker mounting apparatus 1 has holes at positions corresponding to the bosses 51, and is fixed on the cabinet 50 by screwing screws 60 inserted through the holes into the bosses 51.

Figure 7:
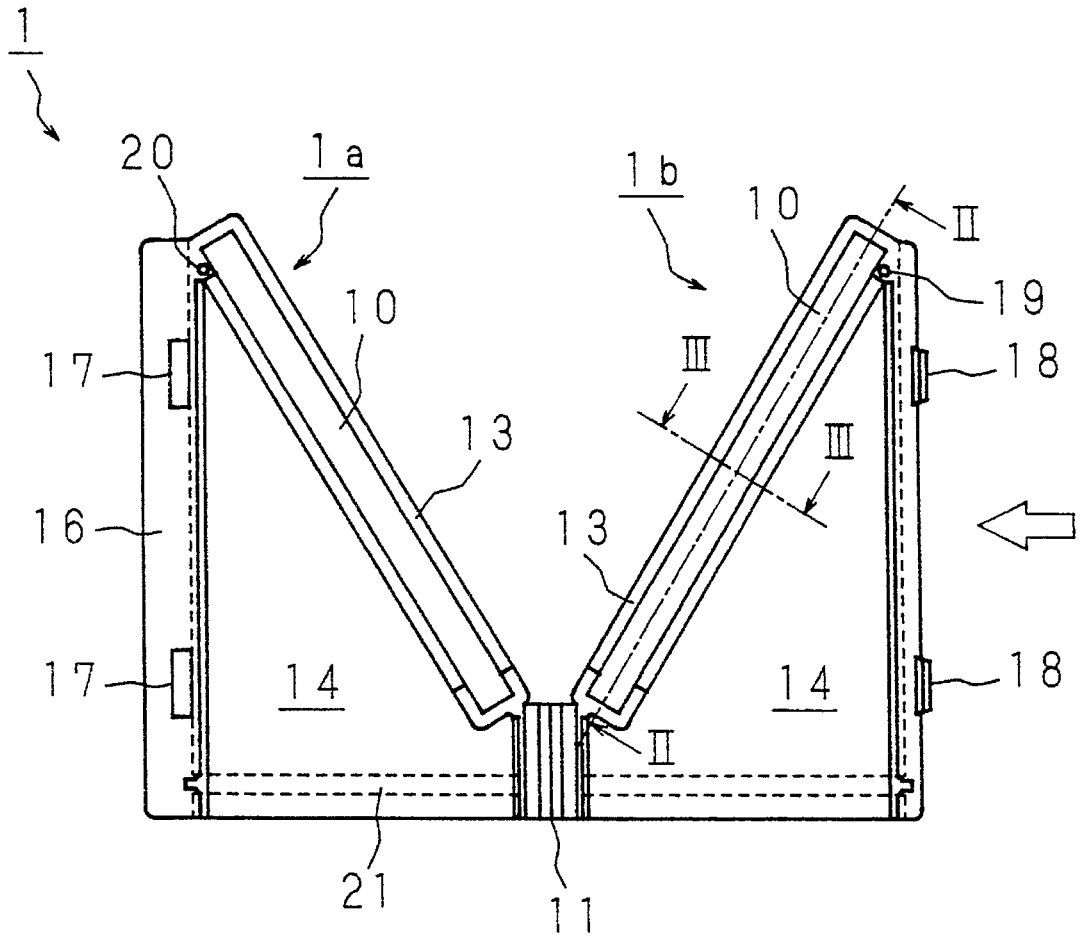
FIG. 7 is a plan view of the loudspeaker mounting apparatus of the invention in the open state.
Figure 8:
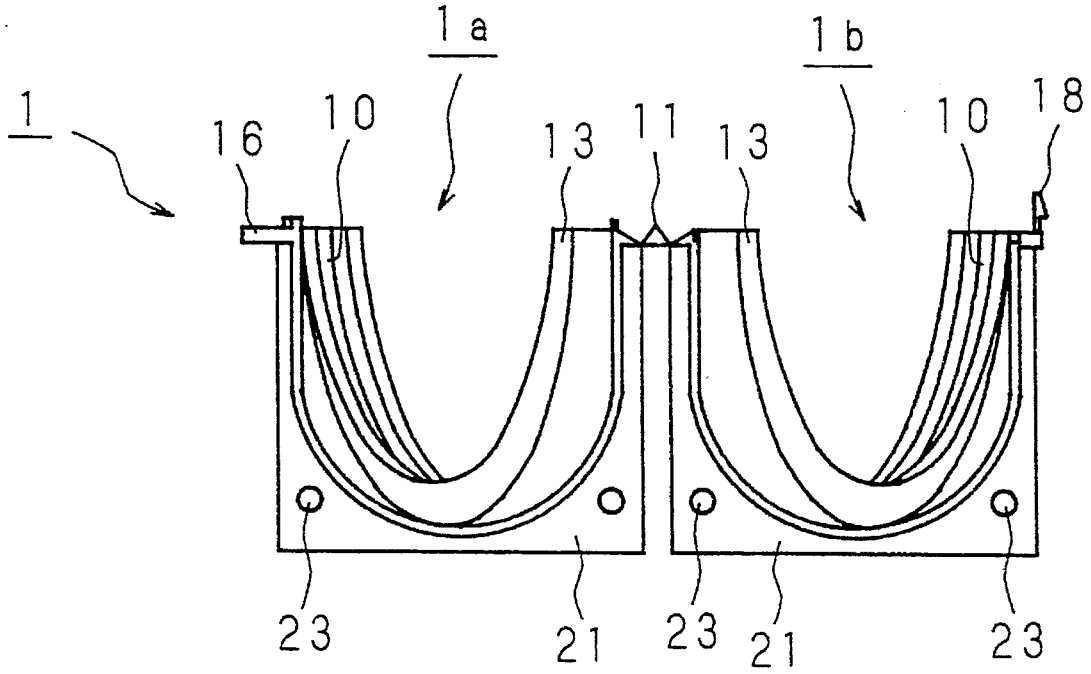
FIG. 8 is a front view of the loudspeaker mounting apparatus of the invention in the open state.
Figure 9:
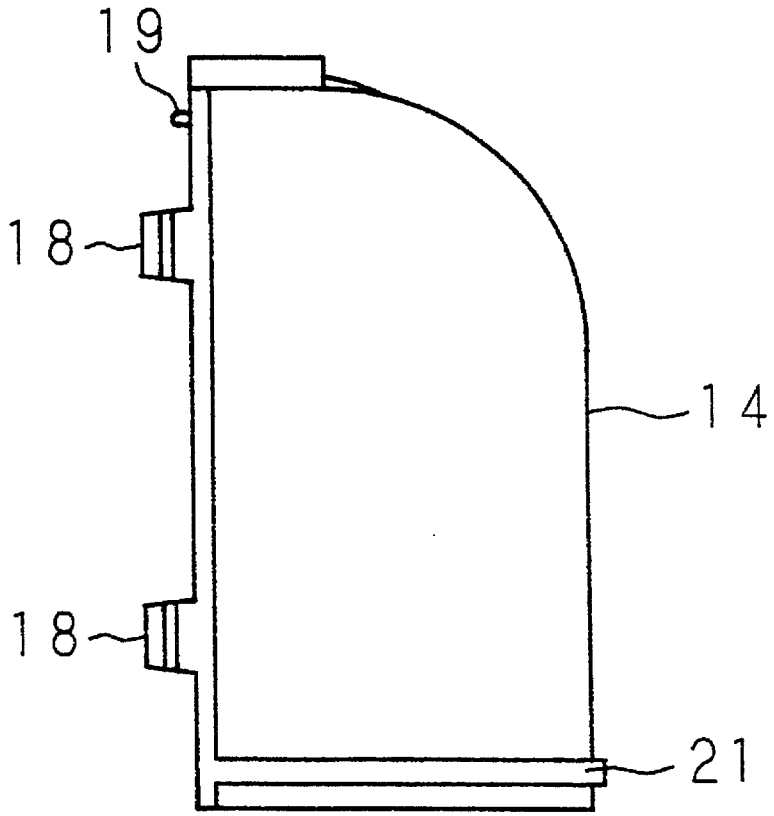
FIG. 9 is an elevational view of the loudspeaker mounting apparatus seen in the direction of a white arrow of FIG. 7.
Figure 10:
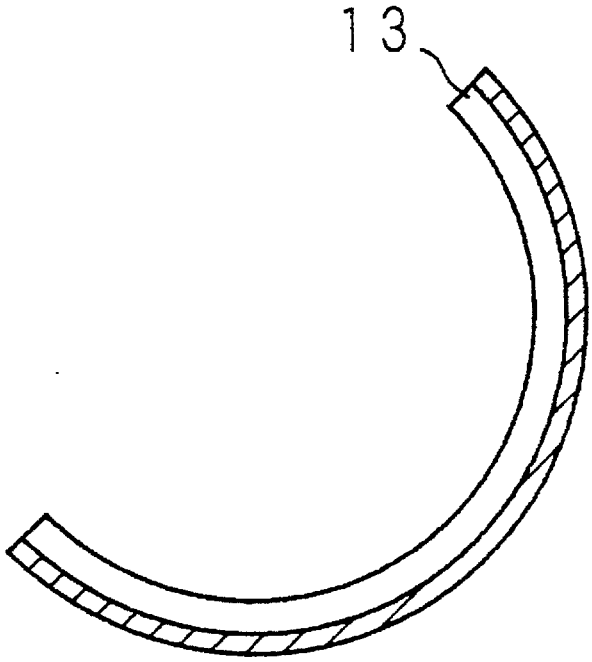
FIG. 10 is a sectional view of the loudspeaker mounting apparatus taken on line II—II of FIG. 7.
Figure 11:
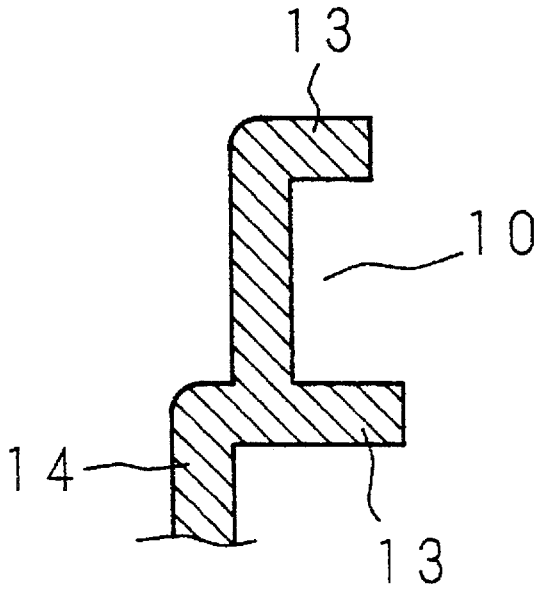
FIG. 11 is a sectional view of the loudspeaker mounting apparatus taken on line III—III of FIG. 7.
Figure 12:
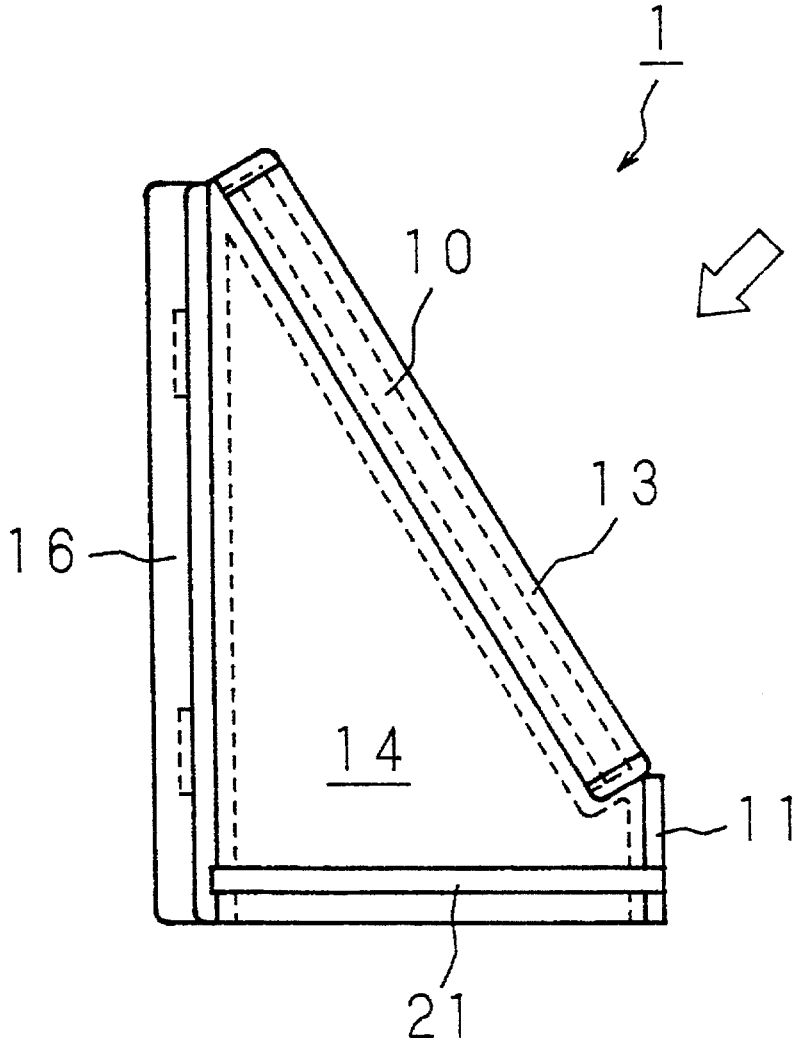
FIG. 12 is a plan view of the loudspeaker mounting apparatus of the invention in the close state.
Figure 13:
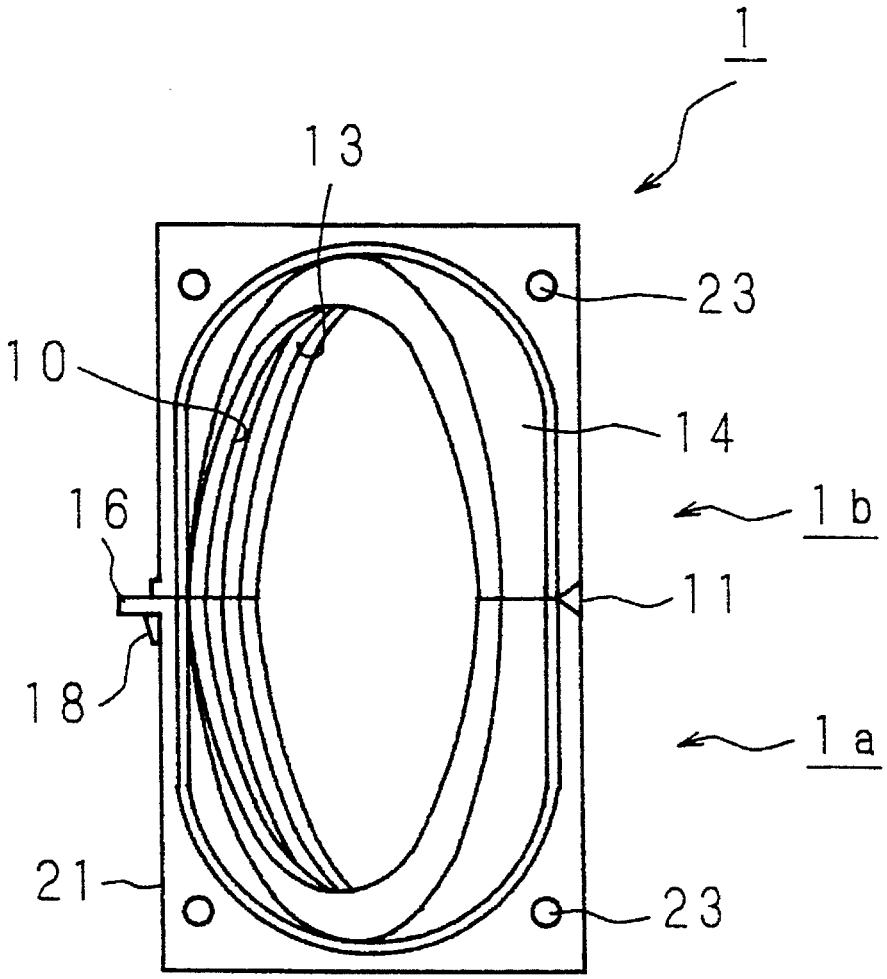
FIG. 13 is a front view of the loudspeaker mounting apparatus of the invention in the close state.
Figure 14:
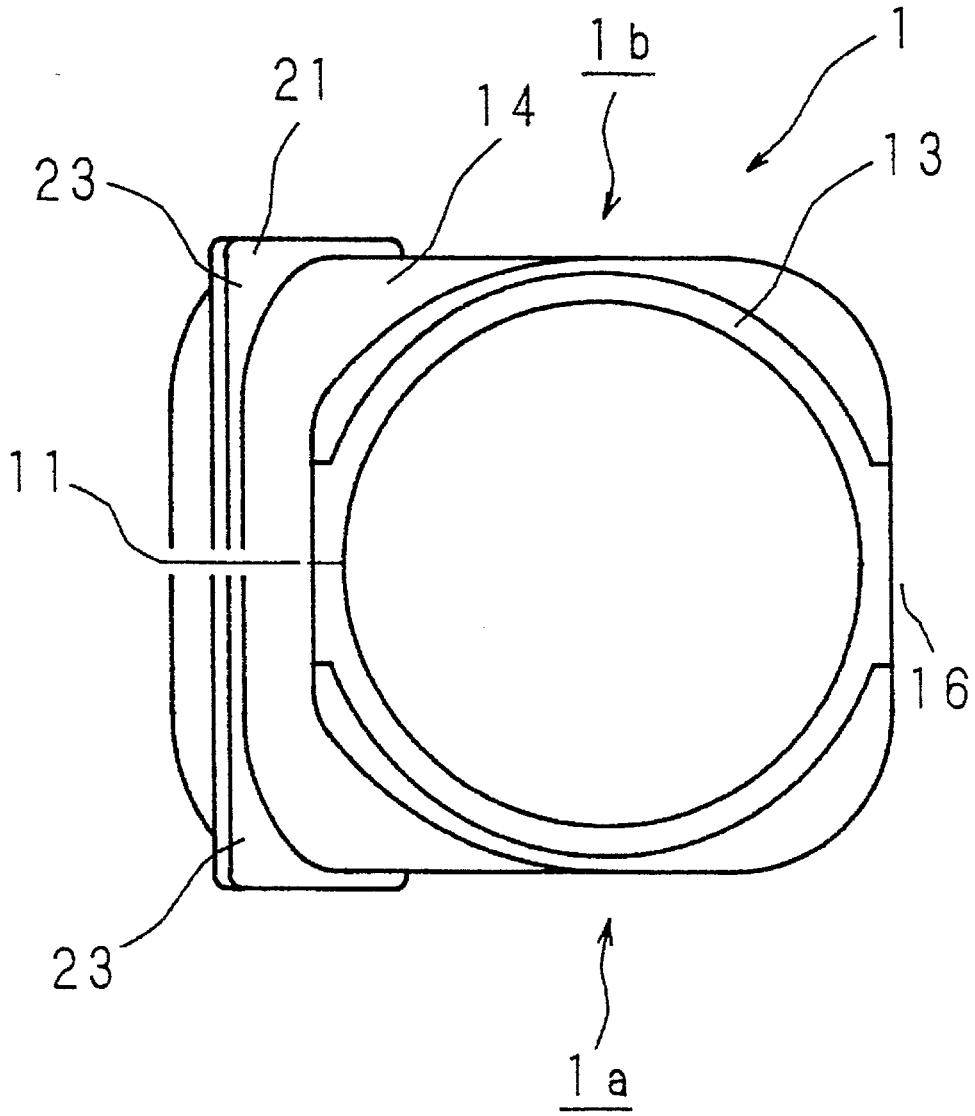
FIG. 14 is an elevational view of the loudspeaker mounting apparatus seen in the direction of a white arrow of FIG. 12.

FIG. 7 is a plan view of the loudspeaker mounting apparatus 1 of this invention in the open state, and FIG. 8 is a front view thereof. FIG. 9 is an elevational view of the loudspeaker mounting apparatus 1 seen in the direction of a white arrow of FIG. 7. FIGS. 10 and 11 are sectional views of the loudspeaker mounting apparatus 1 taken on line II—II and III—III, respectively. FIG. 12 is a plan view of the loudspeaker mounting apparatus 1 of this example in the closed state, and FIG. 13 is a front view thereof. FIG. 14 is an elevational view of the loudspeaker mounting apparatus 1 seen in the direction of a white arrow of FIG. 12. As is shown in FIG. 13, the loudspeaker mounting apparatus 1 comprises a cylindrical portion 14 that looks in the shape of an ellipse when seen from the front. Around one end of the cylindrical portion 14 is provided externally a fixing plate 21 for fixing the loudspeaker mounting apparatus 1 on the cabinet 50 (as is shown in FIG. 6). The fixing plate 21 has holes 23 for inserting screws at the four corners thereof.

The other end of the cylindrical portion 14 is slanting, and hence the cylindrical portion 14 is approximately in the shape of a trapezoid when planarly seen as in FIG. 12. As is shown in FIG. 14, a fixing portion 13 for fixing a loudspeaker on the loudspeaker mounting apparatus 1. The fixing portion 13 includes a groove 10 having a U-shaped section when sectionally seen at inside of the cylindrical portion 14, as is shown in FIGS. 10 and 11. The peripheral edge of a flange 26 of a loudspeaker 25 is fit in the groove 10 as is shown in FIG. 6. On the side face of the cylindrical portion 14, which corresponds to the upper base of the trapezoid when planarly seen, is provided a hinge 11. As is shown in FIGS. 7 and 8, the loudspeaker mounting apparatus 1 is opened with the hinge 11 as a pivot to be separated into two frames 1*a* and 1*b*.

As is shown in FIGS. 7, 8 and 9, the frame 1*a* is provided with a plate 16 having lock holes 17 at a portion not connected with the frame 1*b* by the hinge 11, and the other frame 1*b* is provided with projections 18 each having a tip in the shape of an arrowhead at positions corresponding to the lock holes 17. When the loudspeaker mounting apparatus 1 is closed, the projections 18 are inserted into and engaged with the lock holes 17. The frame 1*a* is also provided with a recession 20 in the vicinity of the contact point between the fixing portion 13 and the plate 16, and the frame 1*b* is provided with a convex part, 19 at a position corresponding to the concave part 20. When the loudspeaker mounting apparatus 1 is closed, the convex part 19 is also fit within the concave part 20 in addition to the projections 18 engaging with the lock holes 17. In this manner, the plate 16 is caught by the arrowhead-shaped tips of the projections 18, thereby locking the frames 1*a* and 1*b* into each other.

The loudspeaker mounting apparatus 1 is solid molded by the injection molding using a mold which corresponds to the loudspeaker mounting apparatus in the open state as is shown in FIG. 7 and a resin material such as polypropylene, polyethylene and soft vinyl chloride. Therefore, the mold can be designed and produced with ease, resulting in decreasing the production cost for the mold.

Figure 15:
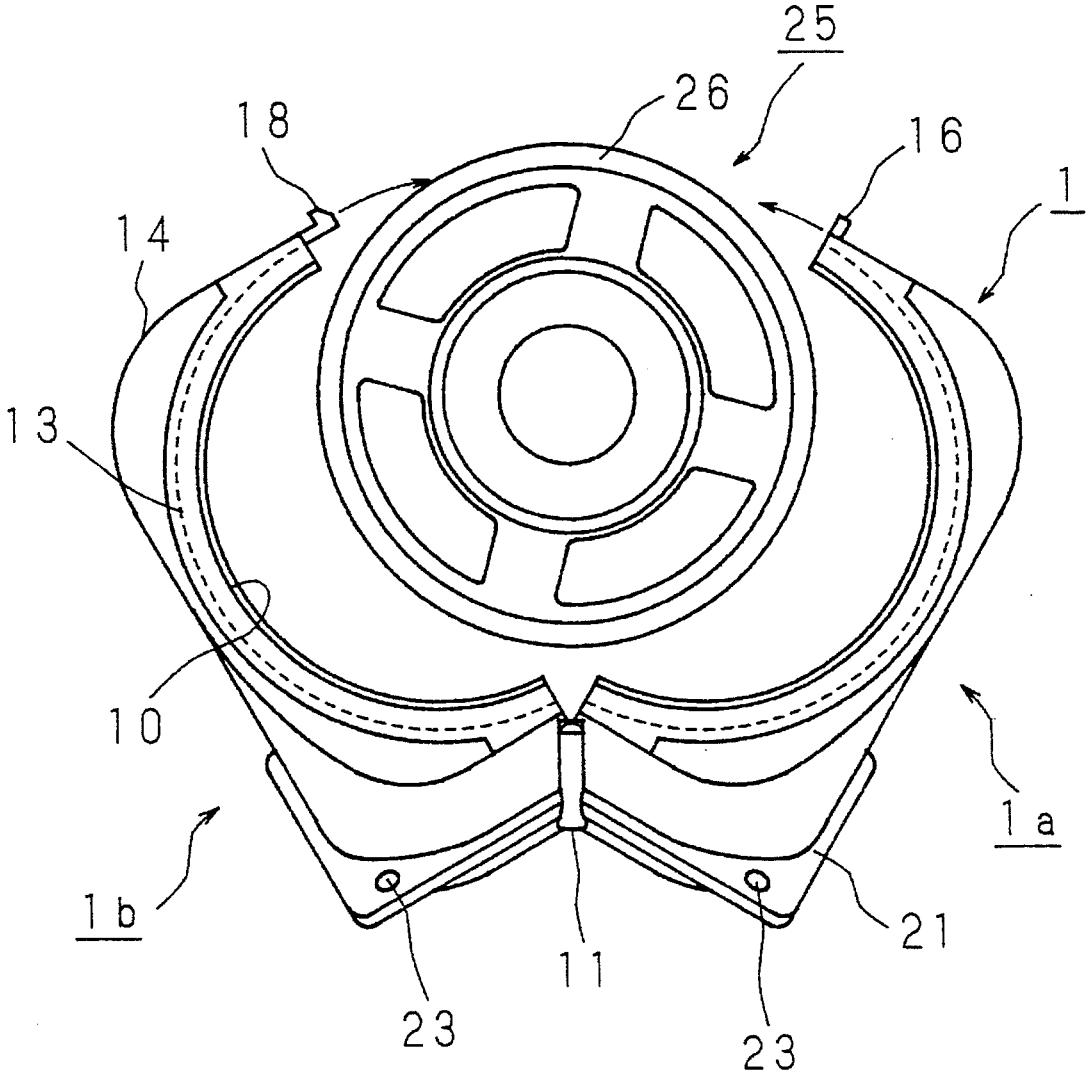
FIG. 15 is a front view of the loudspeaker mounting apparatus of the invention while fixing a loudspeaker thereon.
Figure 16:
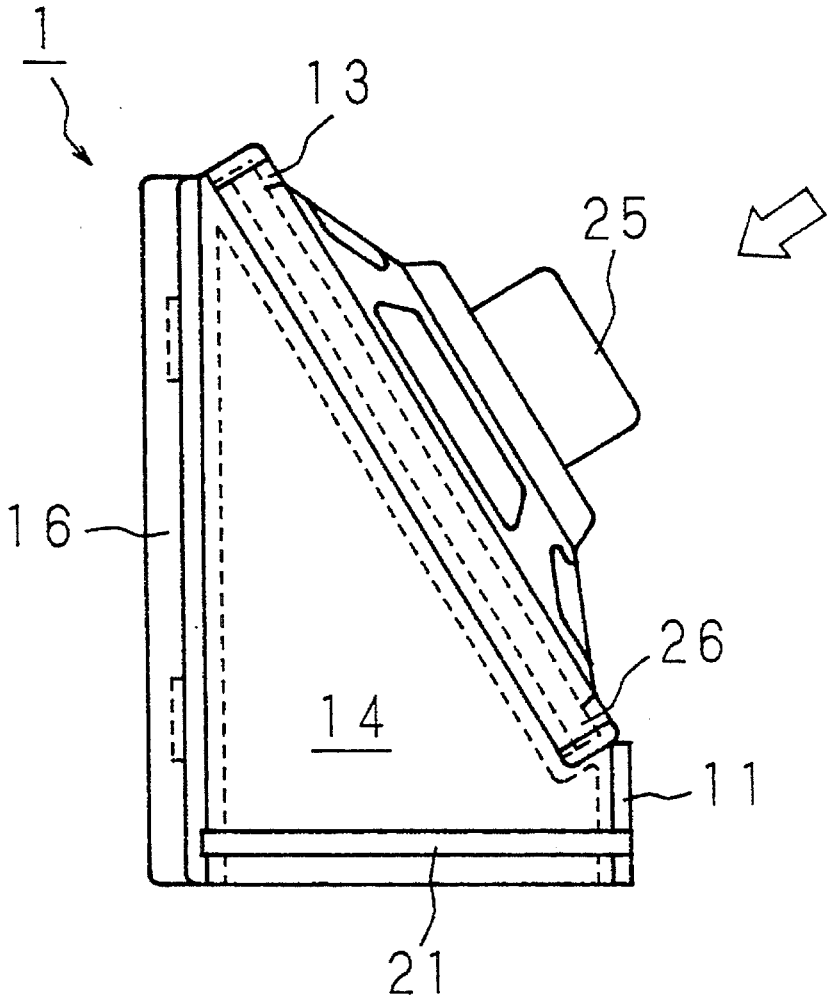
FIG. 16 is a plan view of the loudspeaker mounting apparatus of the invention on which a loudspeaker is fixed.
Figure 17:
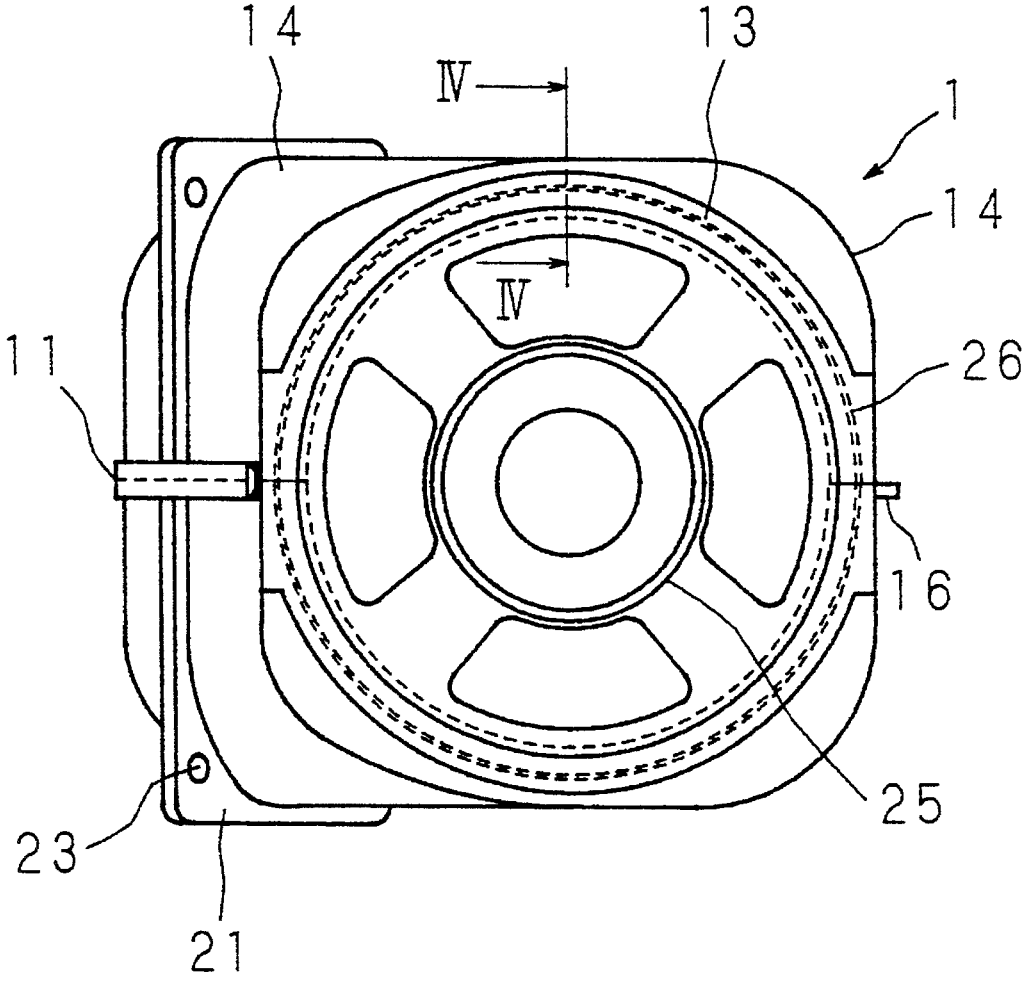
FIG. 17 is an elevational view of the loudspeaker mounting apparatus seen in the direction of a white arrow of FIG. 16.
Figure 18:
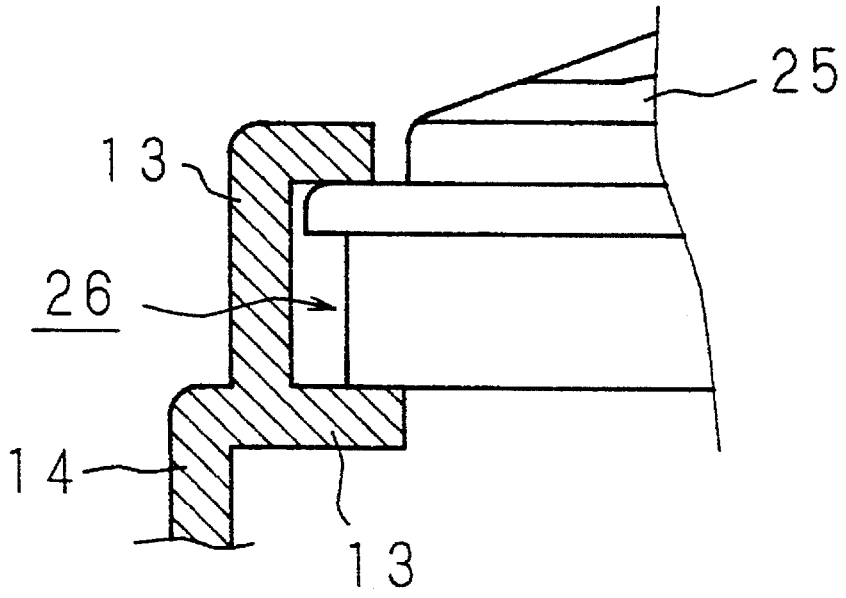
FIG. 18 is a sectional view of the loudspeaker mounting apparatus taken on line IV—IV of FIG. 17.

FIG. 15 is a front view of the loudspeaker mounting apparatus 1 of the invention while fixing the loudspeaker 25 thereon. FIG. 16 is a plan view of the loudspeaker mounting apparatus 1 on which the loudspeaker 25 is already fixed. FIG. 17 is an elevational view of the loudspeaker mounting apparatus 1 seen in the direction of a white arrow of FIG. 16. FIG. 18 is a sectional view of the loudspeaker mounting apparatus 1 taken on line IV—IV of FIG. 17. As is shown in FIG. 15, the frames 1*a* and 1*b* are rotated in the directions of arrows with the hinge 11 as a pivot, while allowing the peripheral edge of the flange 26 of the loudspeaker 25 to be inserted into the groove 10 in the fixing portion 13 as shown in FIG. 18. Then, the projections 18 are fit within the lock holes 17, thereby locking the frames 1*a* and 1*b* into each other. Thus, the loudspeaker 25 can be fixed on the loudspeaker mounting apparatus 1 rapidly with ease without using any screws.

Embodiment 2

Figure 19:
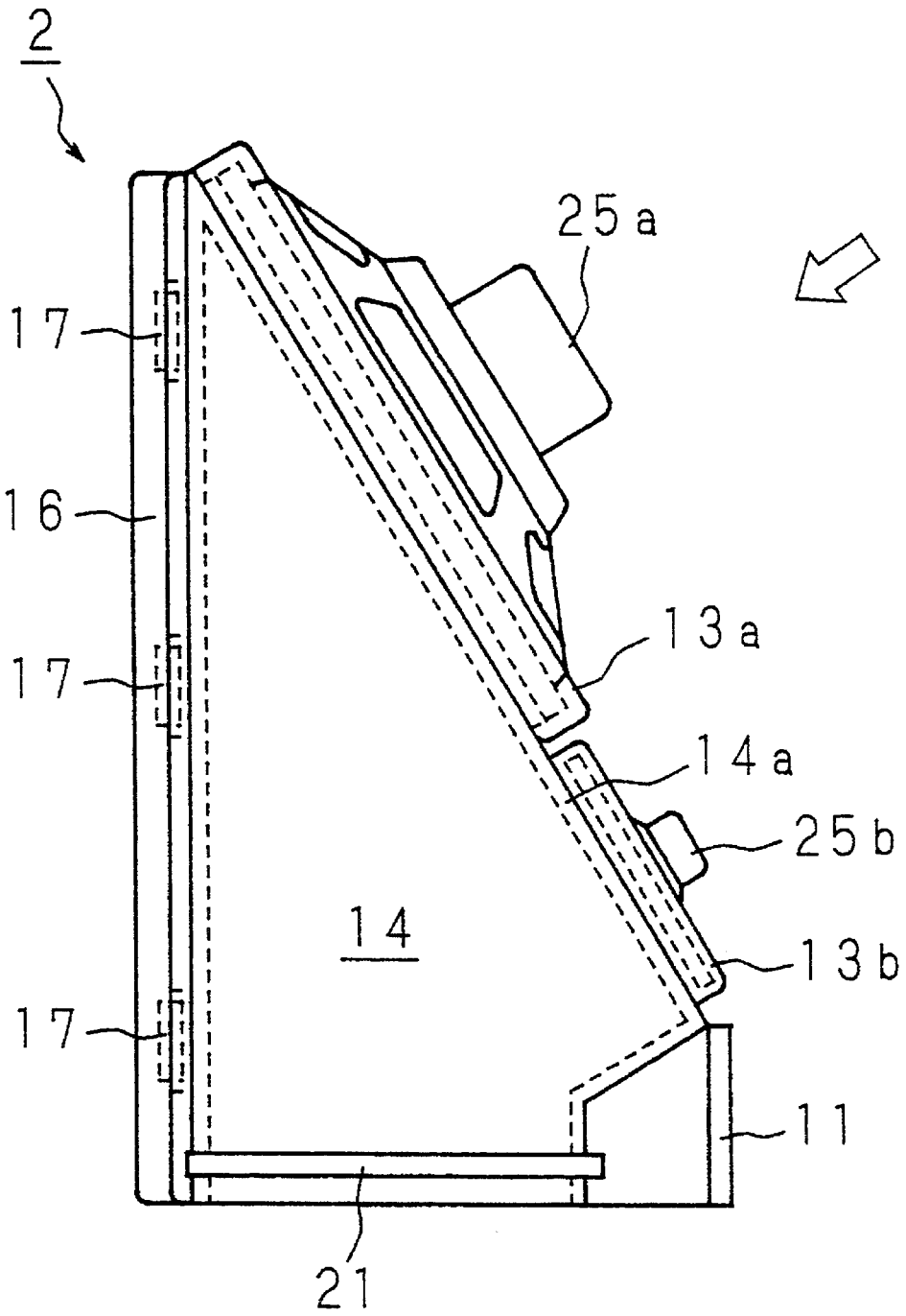
FIG. 19 is a plan view of a loudspeaker mounting apparatus according to another embodiment of the invention.
Figure 20:
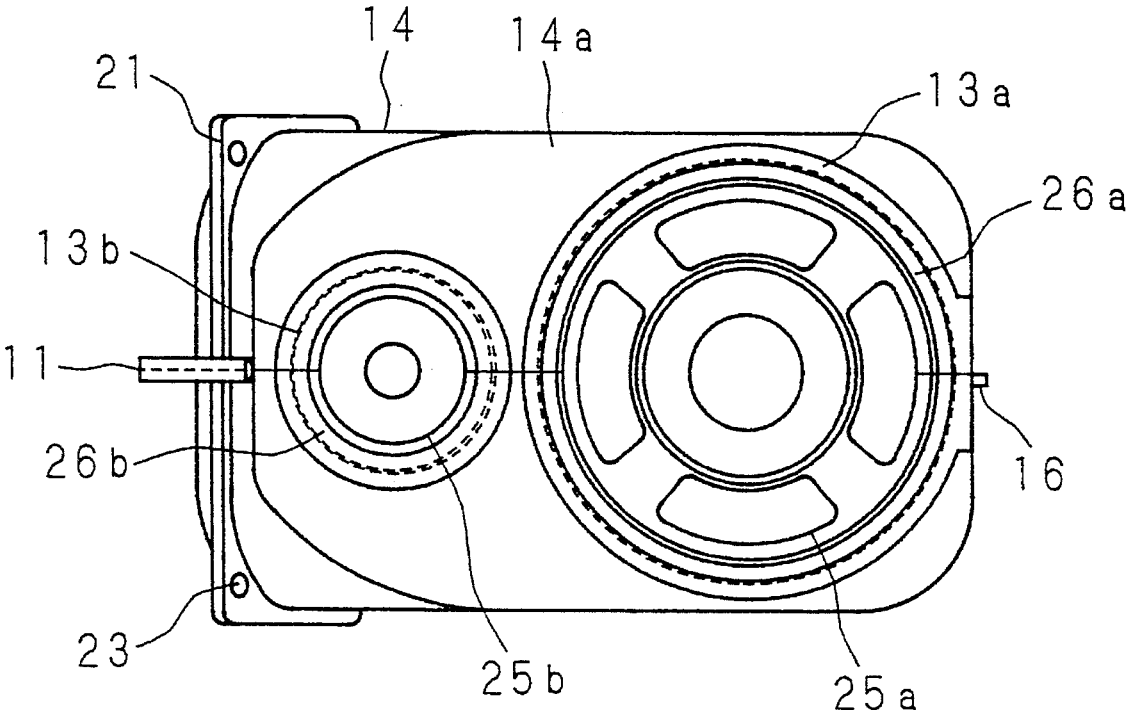
FIG. 20 is an elevational view of the loudspeaker mounting apparatus seen in the direction of a white arrow of FIG. 19.
Figure 21:
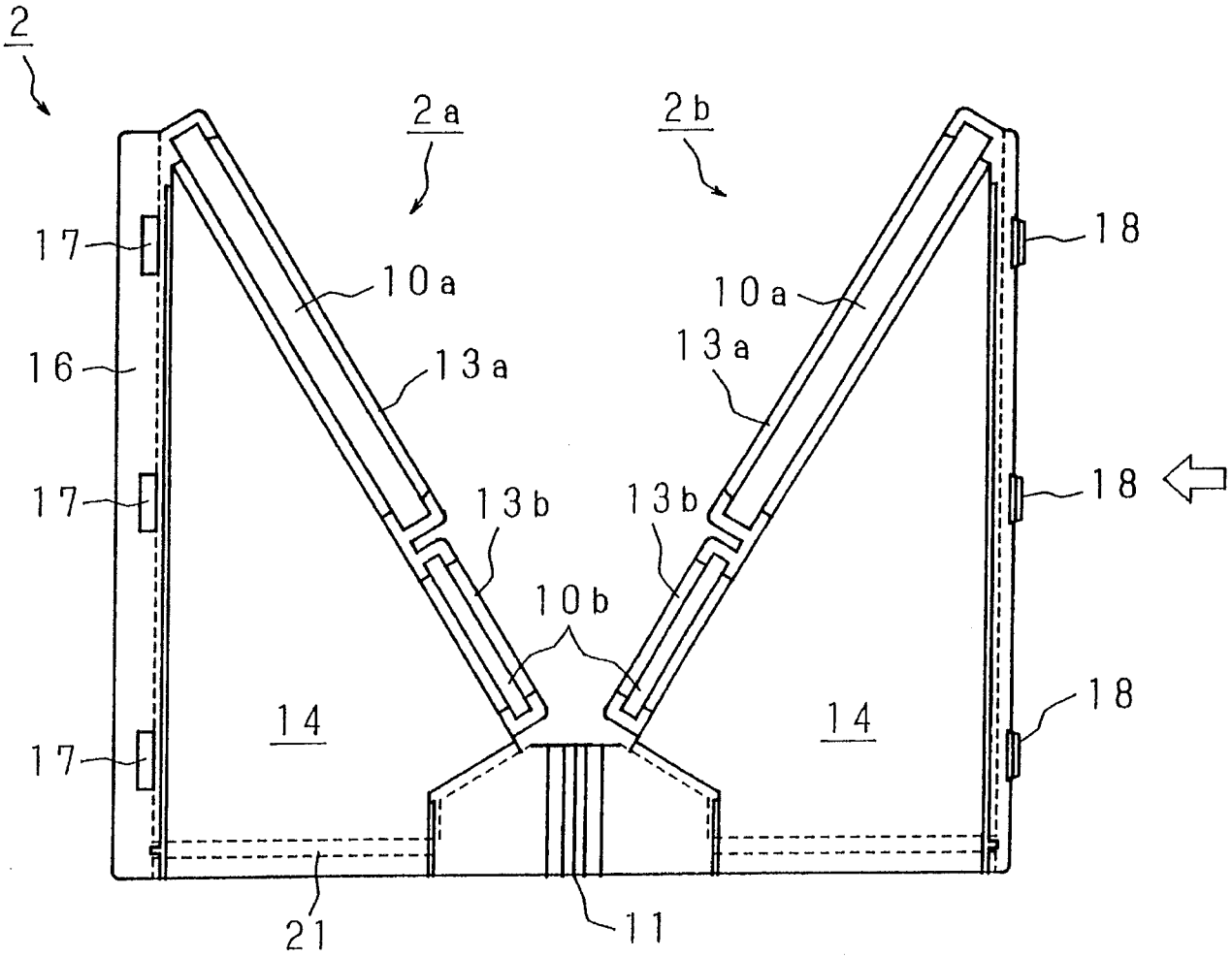
FIG. 21 is a plan view of the loudspeaker mounting apparatus of FIG. 19 in the open state.
Figure 22:
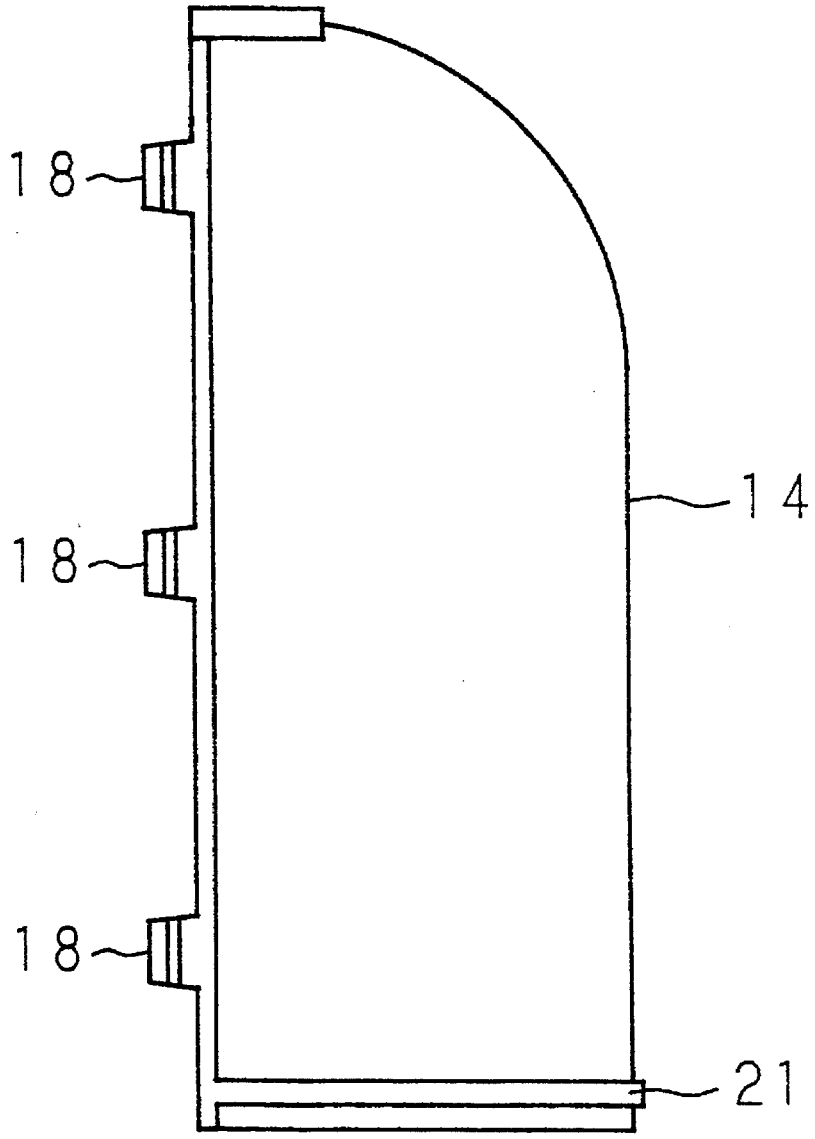
FIG. 22 is an elevational view of the loudspeaker mounting apparatus seen in the direction of a white arrow of FIG. 21.

FIG. 19 is a plan view of a loudspeaker mounting apparatus 2 of another embodiment according to this invention, which is applicable to a two-way loudspeaker. FIG. 20 is an elevational view of the loudspeaker mounting apparatus 2 seen in the direction of a white arrow of FIG. 19, FIG. 21 is a plan view of the loudspeaker mounting apparatus 2 in the open state, and FIG. 22 is an elevational view of the loudspeaker mounting apparatus 2 seen in the direction of a white arrow of FIG. 21. In these drawings, like elements shown in FIG. 7 are referred to with like reference numerals and the description is herein omitted. The slanting end of the cylindrical portion 14 is closed with a back board 14*a*. The back board 14*a* is provided with a large opening and a small opening. Around the edge of the large opening is provided a fixing portion 13*a* having a groove 10*a*, and around the edge of the small opening is provided a fixing portion 13*b* having a groove 10*b*.

The cylindrical portion 14 has the hinge 11 on its side face, and the loudspeaker mounting apparatus 2 is opened with the hinge 11 as a pivot to be separated into two frames 2*a* and 2*b*. In closing the loudspeaker mounting apparatus 2 with the hinge 11 as a pivot, a flange 26*a* of a loudspeaker 25*a* for the low compass is allowed to be inserted into the groove 10*a* in the fixing portion 13*a*, a flange 26*b* of a loudspeaker 25*b* for the high compass is allowed to be inserted into the groove 10*b* in the fixing portion 13*b*, and the projections 18 are inserted into and fit within the lock holes 17 in the plate 16, thereby locking the frames 2*a* and 2*b* into each other. Thus, the loudspeakers 25*a* and 25*b* are fixed on the loudspeaker mounting apparatus 2 without using any screws.

Embodiment 3

Figure 23:
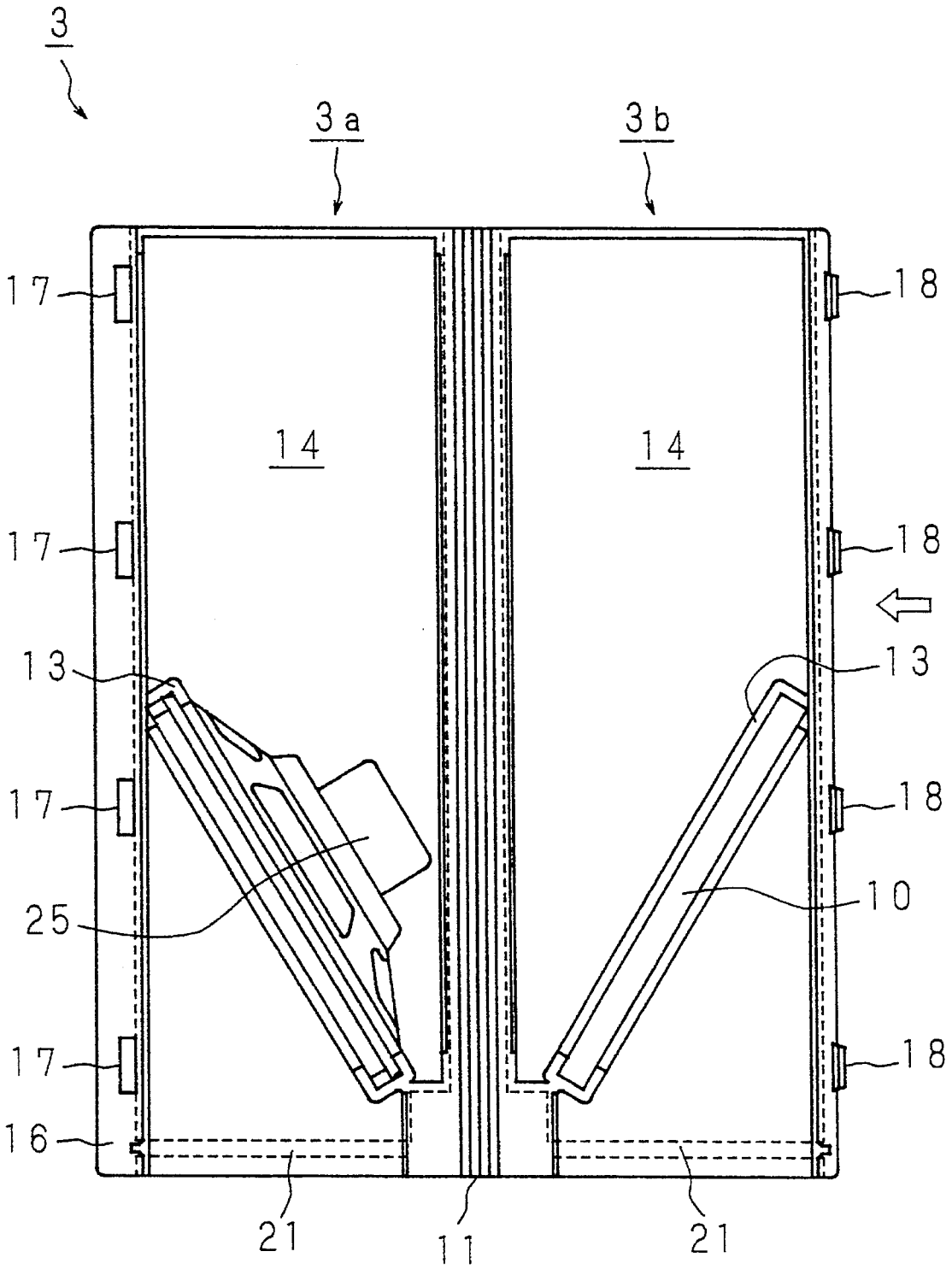
FIG. 23 is a plan view of a loudspeaker mounting apparatus according to still another embodiment of the invention.
Figure 24:
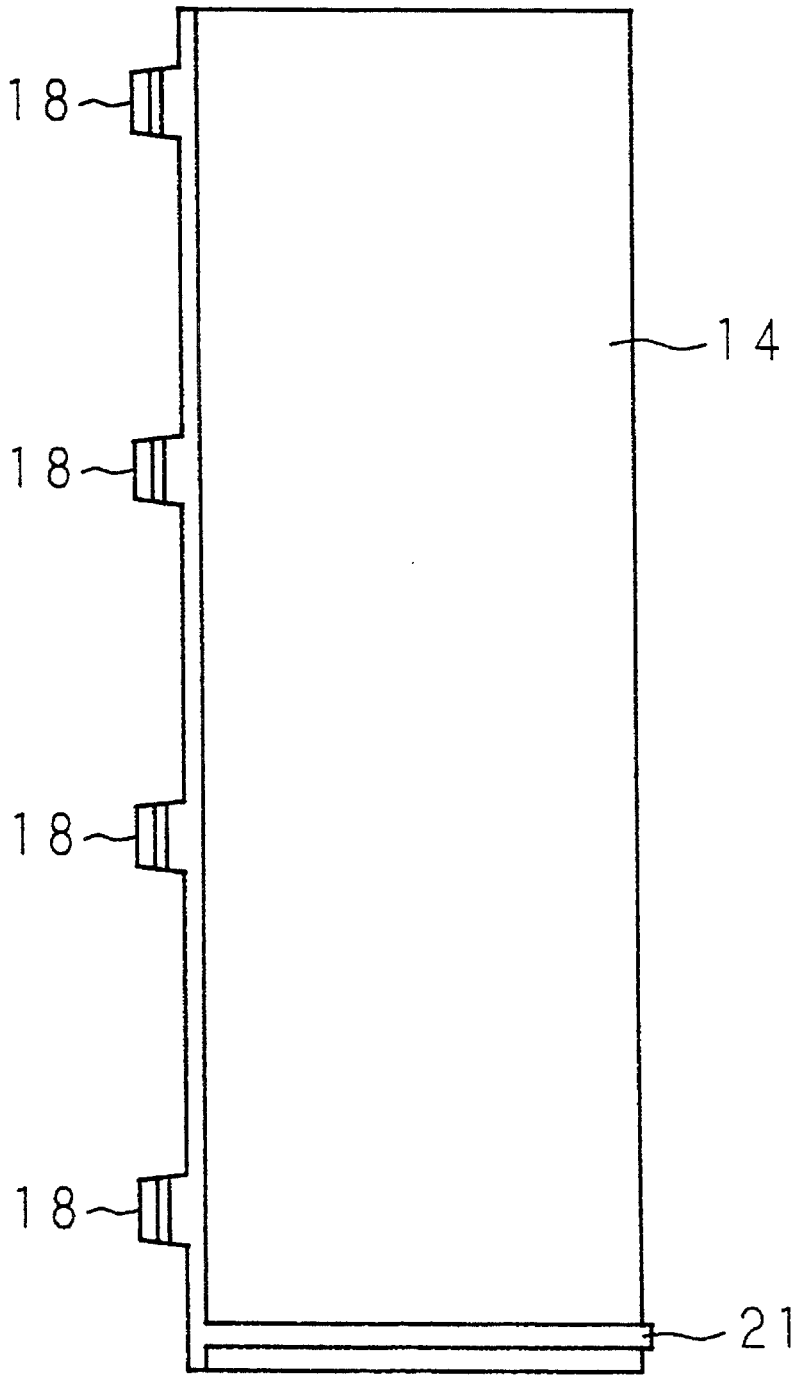
FIG. 24 is an elevational view of the loudspeaker mounting apparatus seen in the direction of a white arrow of FIG. 23.

FIG. 23 is a plan view of a loudspeaker mounting apparatus 3 according to another embodiment of this invention, and FIG. 24 is an elevational view of the loudspeaker mounting apparatus 3 seen in the direction of a white arrow of FIG. 23. Each of frames 3*a* and 3*b* of the loudspeaker mounting apparatus 3 is in the shape of a vertically divided half of a cylinder 14 having a bottom, and they are connected to each other with a hinge 11. The frames 3*a* and 3*b* are respectively provided with fixing portions 13 each having a groove 10 so as to be inclined symmetrically to each other and a little closer to the opening than to the center of the loudspeaker mounting apparatus 3. In closing the loudspeaker mounting apparatus 3, a flange 26 of a loudspeaker 25 is allowed to be inserted into the grooves 10 in the fixing portions 13, while rotating the frames 3*a* and 3*b* with the hinge 11 as a pivot. Then, projections 18 are inserted into lock holes 17, thereby housing the loudspeaker 25 in the loudspeaker mounting apparatus 3 to be fixed. Thus, since the back portion of the loudspeaker 25 is covered with the loudspeaker mounting apparatus 3, sound is prevented from leaking into the cabinet, resulting in improved sound quality.

Embodiment 4

Figure 25:
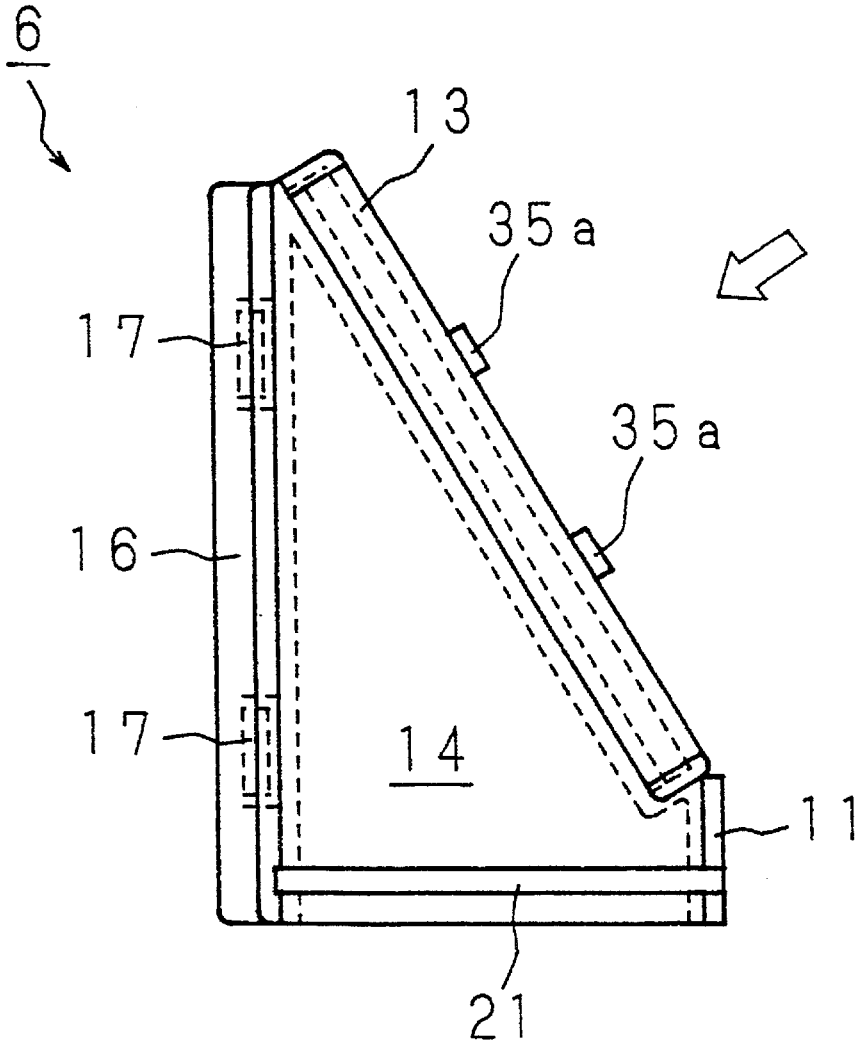
FIG. 25 is a plan view of a loudspeaker mounting apparatus according to still another embodiment of the invention.
Figure 26:
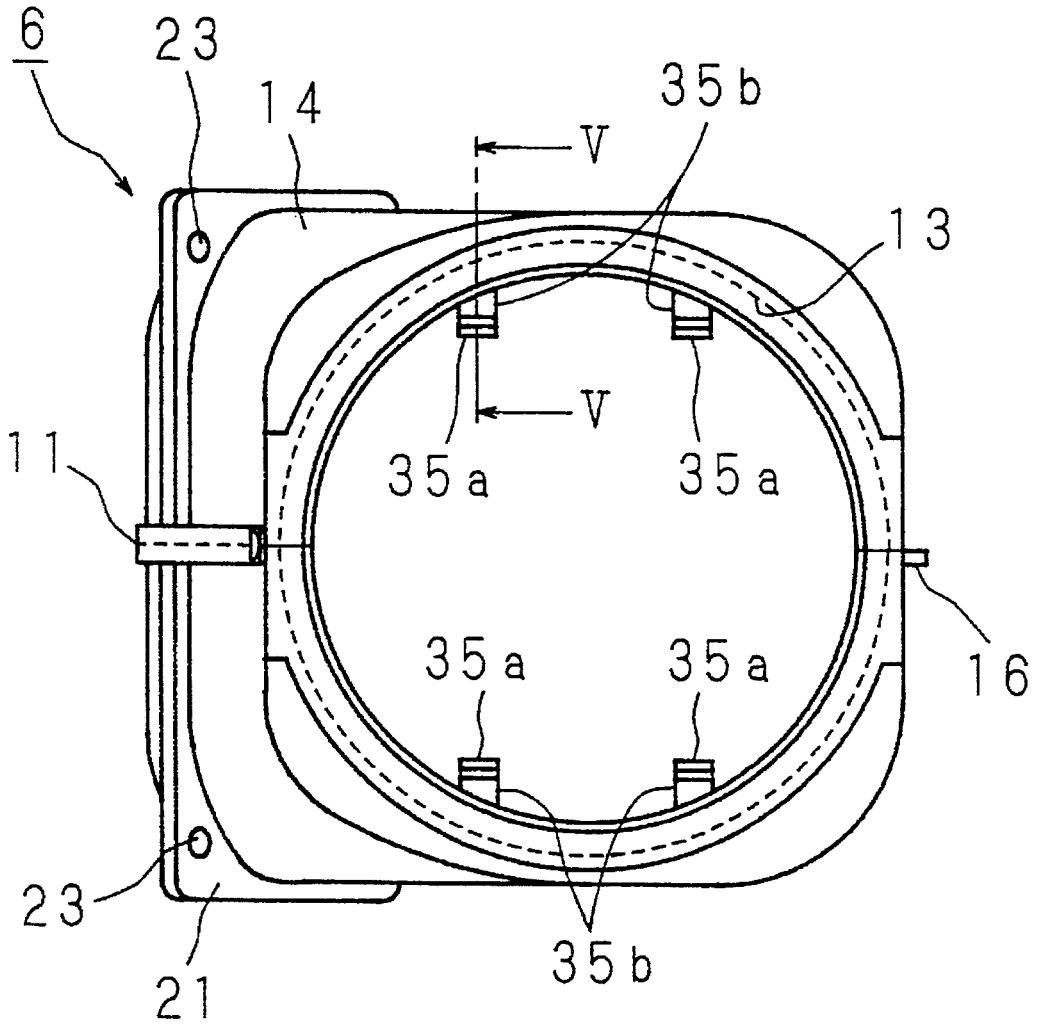
FIG. 26 is an elevational view of the loudspeaker mounting apparatus seen in the direction of a white arrow of FIG. 25.
Figure 27:
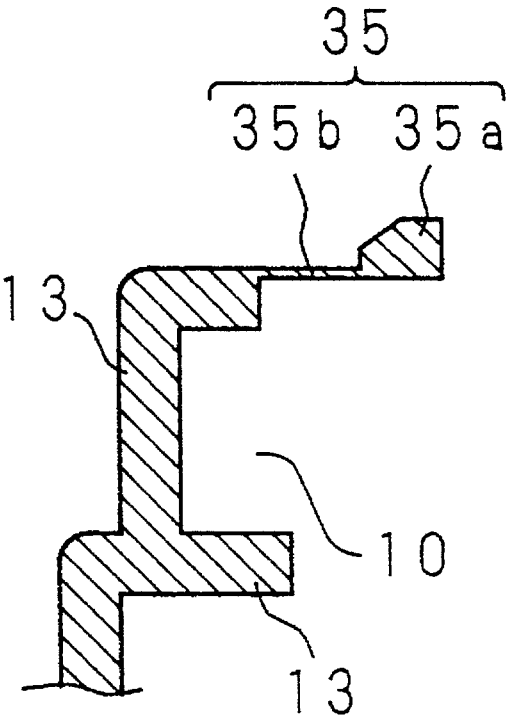
FIG. 27 is a sectional view of the loudspeaker mounting apparatus taken on line V—V of FIG. 26.

FIG. 25 is a plan view of a loudspeaker mounting apparatus of another embodiment according to this invention, which is applicable to a variety of loudspeakers having spacer rings at different heights. The spacer ring is a member provided on a flange of a loudspeaker for securing a space where cone paper is moved by the vibration. Hereinafter, the word "flange height" is used to refer to the height of the flange including the height of the spacer ring for simplifying the description. FIG. 26 is an elevational view of the loudspeaker mounting apparatus seen in the direction of a white arrow of FIG. 25, and FIG. 27 is a sectional view of the loudspeaker mounting apparatus taken on line V—V of FIG. 26. In these drawings, like elements shown in FIG. 7 are referred to like reference numerals and the description is herein omitted. From the peripheral edge of the fixing portion 13 having the groove 10 with a predetermined width, second hinges **35*b* are projecting inward when planarly seen, and each of the second hinges 35*b* has a wedge 35*a* with a desired thickness on the tip thereof. When a loudspeaker having a flange height smaller than the width of the groove 10 is fixed on the fixing portion 13, the wedges 35*a* are bent inward of the groove 10 with the second hinges 35*b* as pivots. As a result, the width of the groove 10 is made smaller by the thickness of each wedge 35*a***, thereby enabling the loudspeaker to be fixed.

Figure 28:
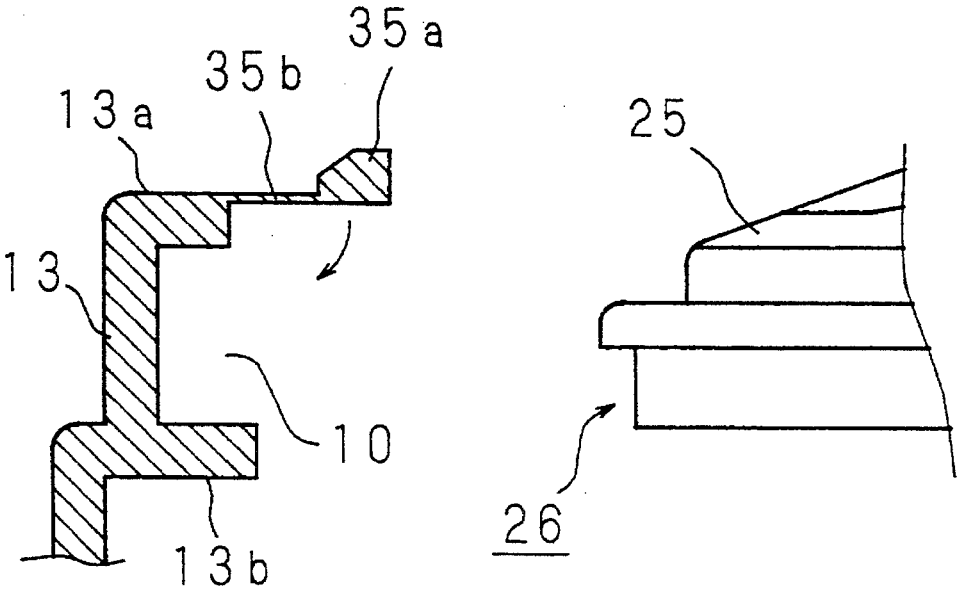
FIG. 28 is a flow chart illustrating a procedure for fixing a loudspeaker having a flange height smaller than the width of a groove in a fixing portion shown in FIG. 27.
Figure 29:
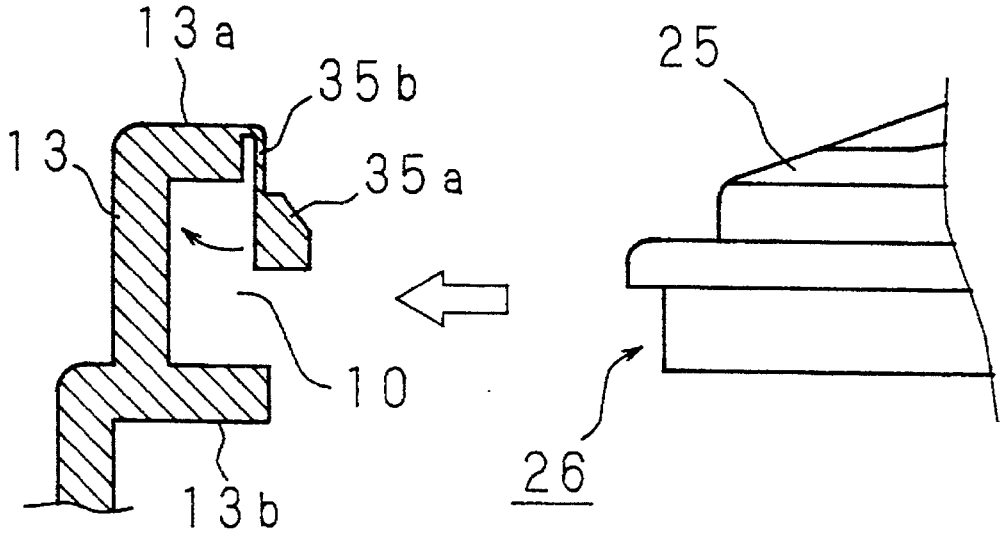
FIG. 29 is a flow chart illustrating the procedure subsequent to that of FIG. 28 for fixing the loudspeaker.
Figure 30:
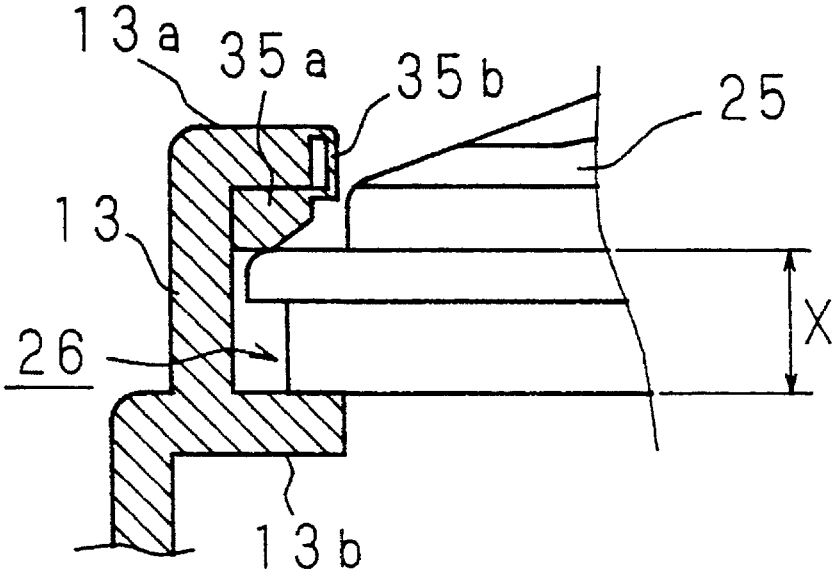
FIG. 30 is a flow chart illustrating the procedure subsequent to that of FIG. 29 for fixing the loudspeaker.

FIGS. 28 through 30 illustrate the procedure for fixing the loudspeaker with a flange height smaller than the width of the groove in the fixing portion of FIG. 27. As is shown in FIG. 28, the second hinge **35*b* and the wedge 35*a* are bent by 90 degrees inward with the outer edge of an outer wall 13*a* of the fixing portion 13 as a pivot. Then, as is shown in FIG. 29, the flange 26 of the loudspeaker 25 is allowed to come in contact, with the wedge 35*a*, and the second hinge 35*b* and the wedge 35*a* are bent by another 90 degrees inward with the inner edge of the outer wall 13*a* as a pivot. Then, as is shown in FIG. 30, the flange 26 of the loudspeaker 25 is inserted into the groove 10. In this manner, the flange 26 of the loudspeaker 25 having a flange height X smaller than the width of the groove 10 in the fixing portion 13 is sandwiched between the wedge 35*a* and an inner-wall 13*b* of the fixing portion 13, thereby fixing the loudspeaker 25 on the fixing portion 13**. When the fixing portion has a plurality of wedges having different widths, it is possible to fix various types of loudspeakers having different flange heights on the fixing portion.

Figure 31:
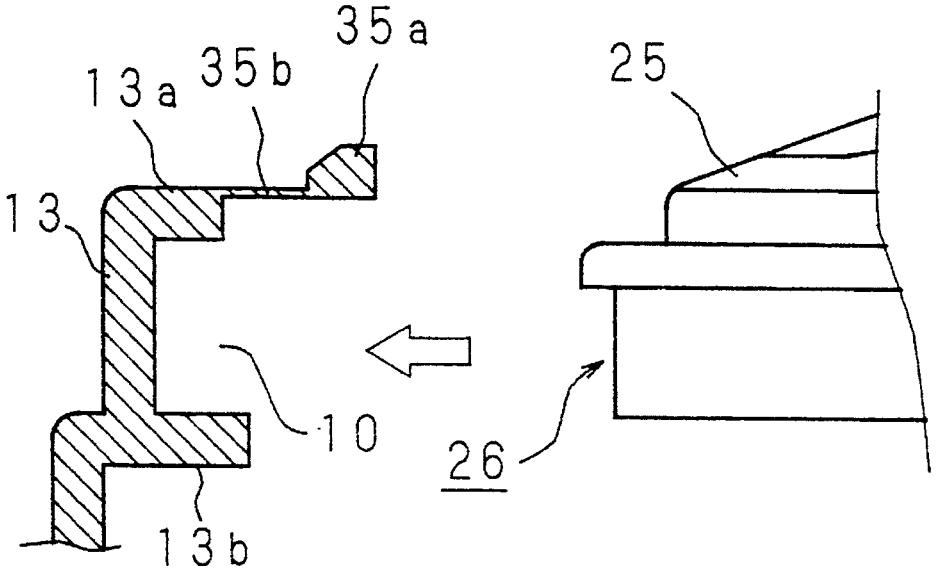
FIG. 31 is a flow chart illustrating a procedure for fixing a loudspeaker having a flange height approximately equal to the width of a groove in the fixing portion shown in FIG. 27.
Figure 32:
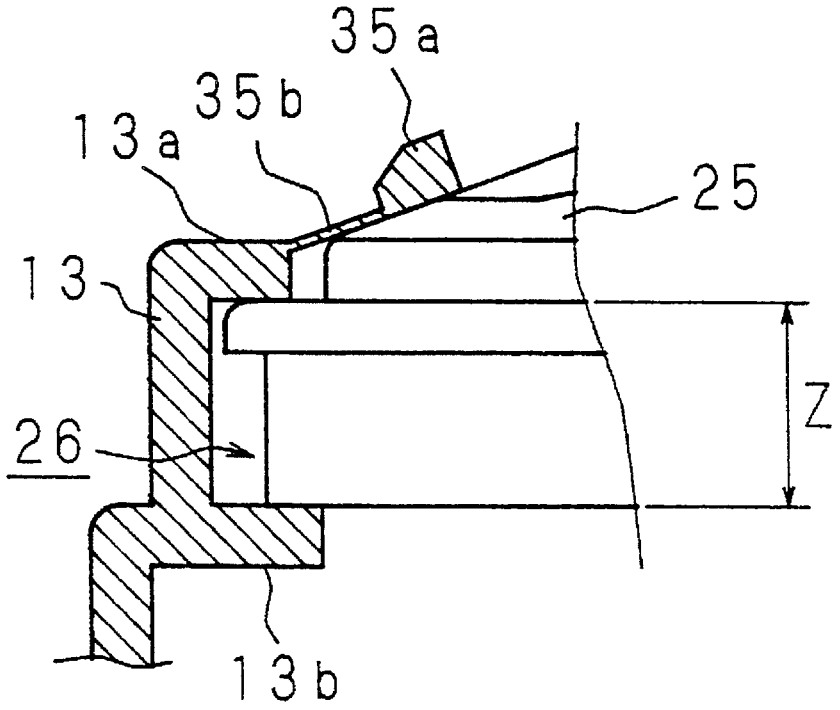
FIG. 32 is a flow chart illustrating the procedure subsequent to that of FIG. 31 for fixing the loudspeaker.

FIGS. 31 and 32 illustrate the procedure for fixing a loudspeaker having a flange height approximately equal to the width of the groove on the fixing portion 13 shown in FIG. 27. As is shown in FIG. 31, the loudspeaker 25 having a flange height Z approximately equal to the width of the groove 10 in the fixing portion 13 is allowed to approach the groove 10, and as is shown in FIG. 32, the flange 26 of the loudspeaker 25 is inserted into the groove 10, while bending the second hinge **35*b* and the wedge 35*a* outward with the outer edge of the outer wall 13*a* of the fixing portion 13** as a pivot.

Embodiment 5

Figure 33:
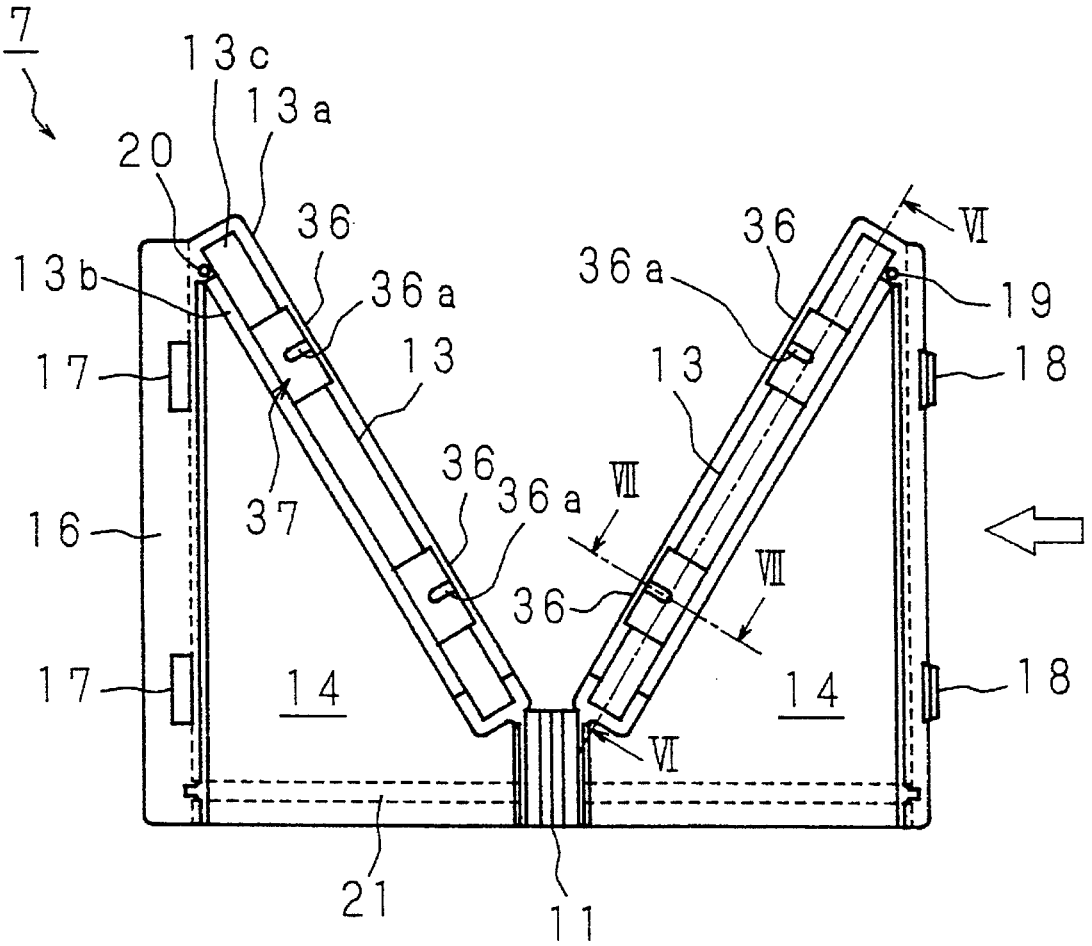
FIG. 33 is a plan view of a loudspeaker mounting apparatus according to still another embodiment of the invention.
Figure 34:
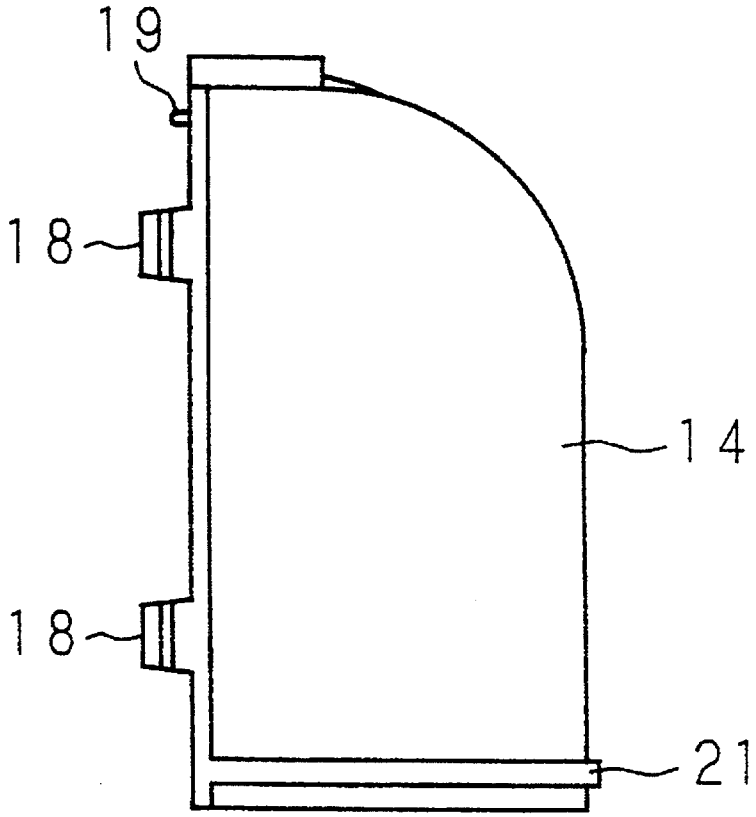
FIG. 34 is an elevational view of the loudspeaker mounting apparatus seen in the direction of a white arrow of FIG. 33.
Figure 35:
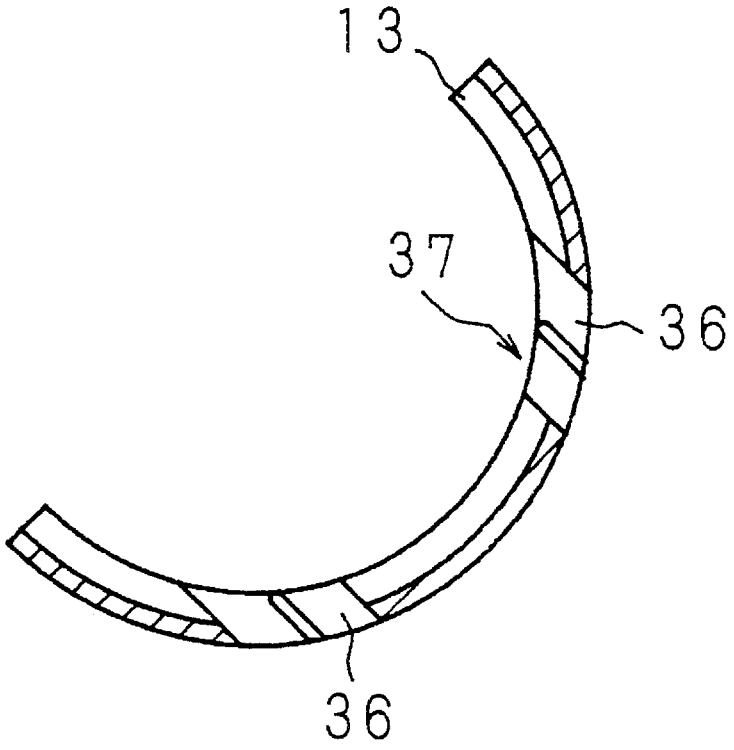
FIG. 35 is a sectional view of the loudspeaker mounting apparatus taken on line VI—VI of FIG. 33.
Figure 36:
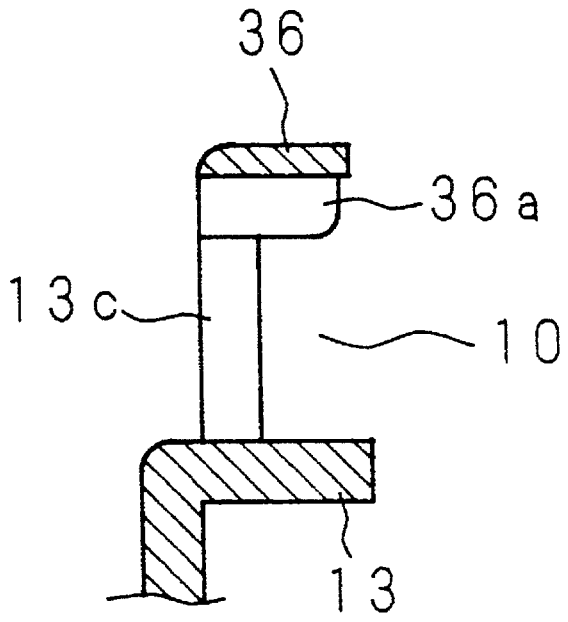
FIG. 36 is a sectional view of the loudspeaker mounting apparatus taken on line VII—VII of FIG. 33.
Figure 37:
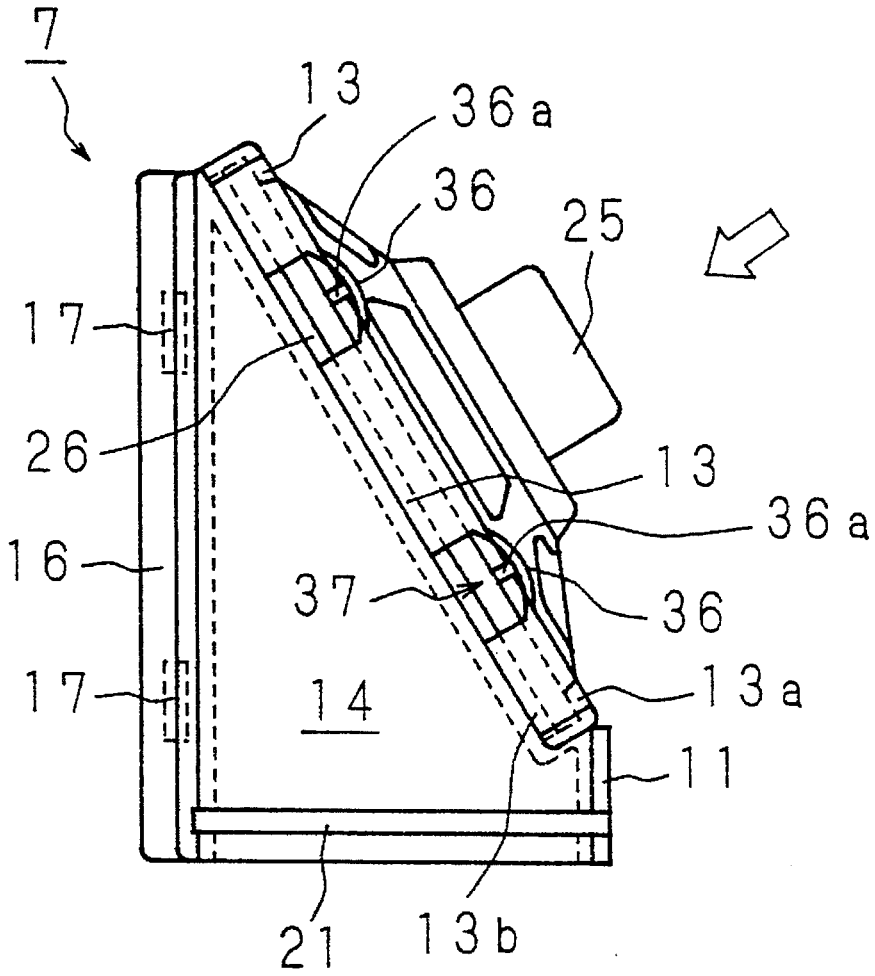
FIG. 37 is a plan view of the loudspeaker mounting apparatus of FIG. 33 on which a loudspeaker is fixed.
Figure 38:
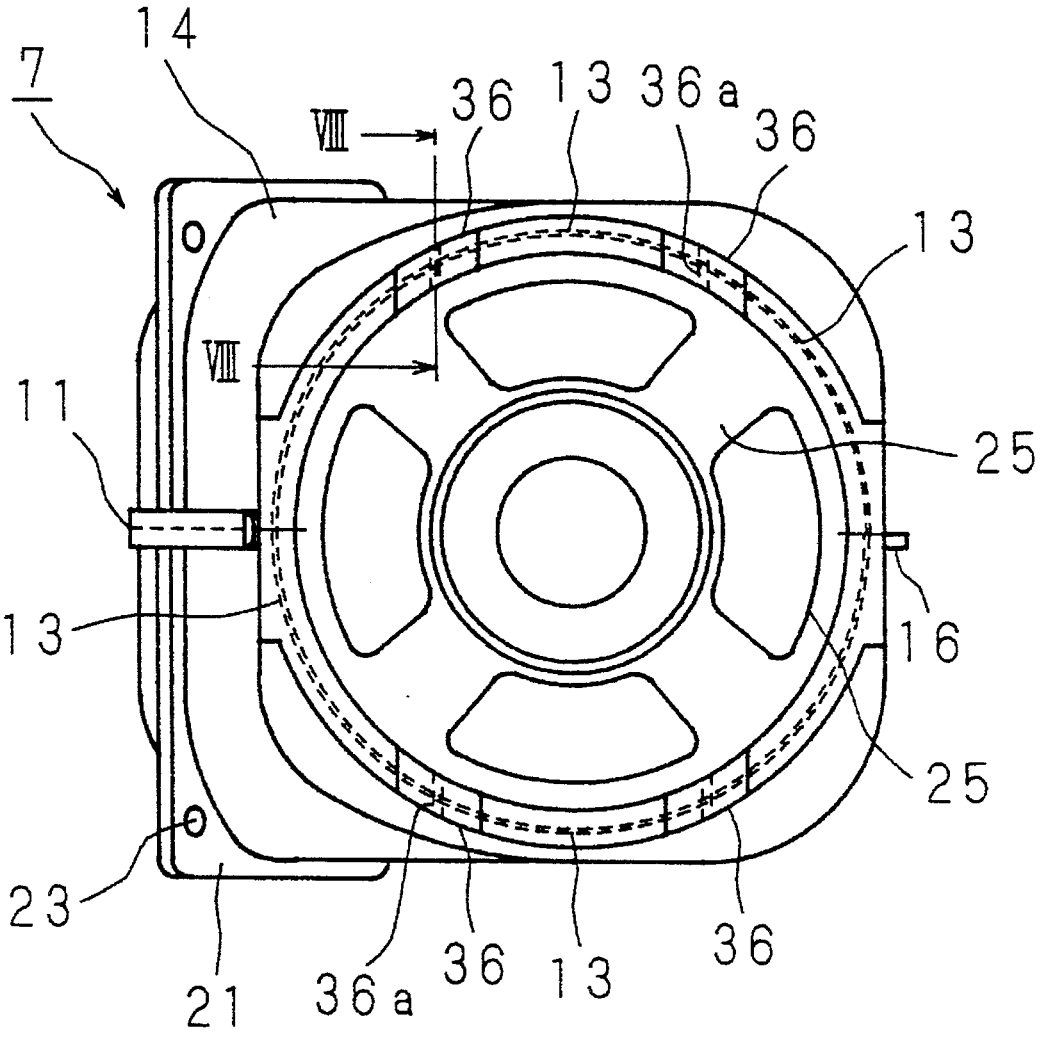
FIG. 38 is an elevational view of the loudspeaker mounting apparatus seen in the direction of a white arrow of FIG. 37.
Figure 39:
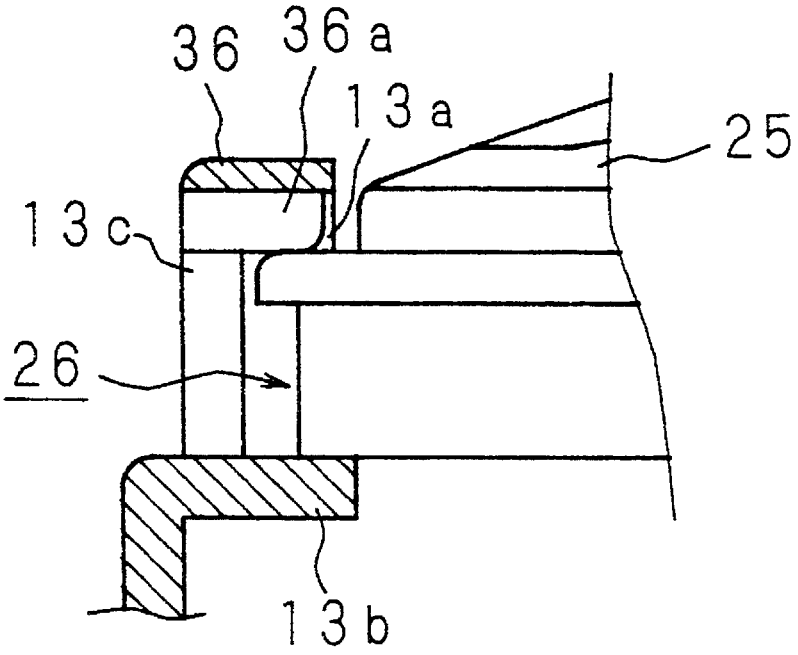
FIG. 39 is a sectional view of the loudspeaker mounting apparatus taken on line VIII—VIII of FIG. 38.

FIG. 33 is a plan view of a loudspeaker mounting apparatus according to another embodiment of this invention, which is also applicable to various types of loudspeakers having different flange heights as in the apparatus of Embodiment 4. FIG. 34 is an elevational view of the loudspeaker mounting apparatus seen in the direction of a white arrow of FIG. 33, and FIGS. 35 and 36 are sectional views of the loudspeaker mounting apparatus taken on line VI—VI and VII—VII of FIG. 33, respectively. FIG. 37 is a plan view of the loudspeaker mounting apparatus on which a loudspeaker is fixed, FIG. 38 is an elevational view of the loudspeaker mounting apparatus seen in the direction of a white arrow of FIG. 37, and FIG. 39 is a sectional view of the loudspeaker mounting apparatus taken on line VIII—VIII of FIG. 38. In these drawings, like elements shown in FIG. 7 are referred to like reference numerals and the description is herein omitted.

On the outer wall **13*a* of the fixing portion 13 are formed a plurality of elastic portions 36 provided with elasticity by decreasing the thickness thereof. The inner walls of the elastic portions 36 facing the groove 10 are provided with a plurality of ribs 36*a* each having a desired height. A peripheral wall 13*c* between the outer wall 13*a* and the inner wall 13*b* of the fixing portion 13 has holes 37 at positions corresponding to the elastic portions 36, so that the elastic portions 36 can bend like a bow when an external force is applied to the elastic portions 36**.

Figure 40:
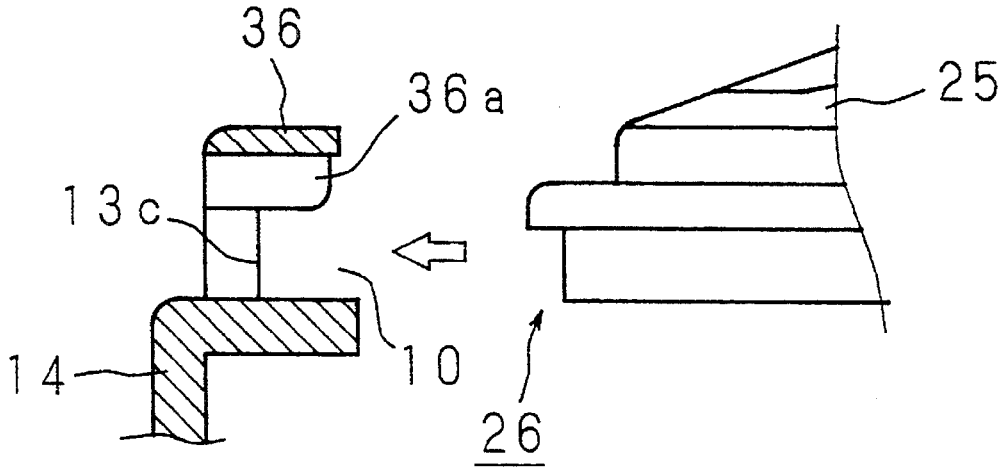
FIG. 40 is a flow chart illustrating a procedure for fixing a loudspeaker having a flange height smaller than the width of a groove in a fixing portion shown in FIG. 36.
Figure 41:
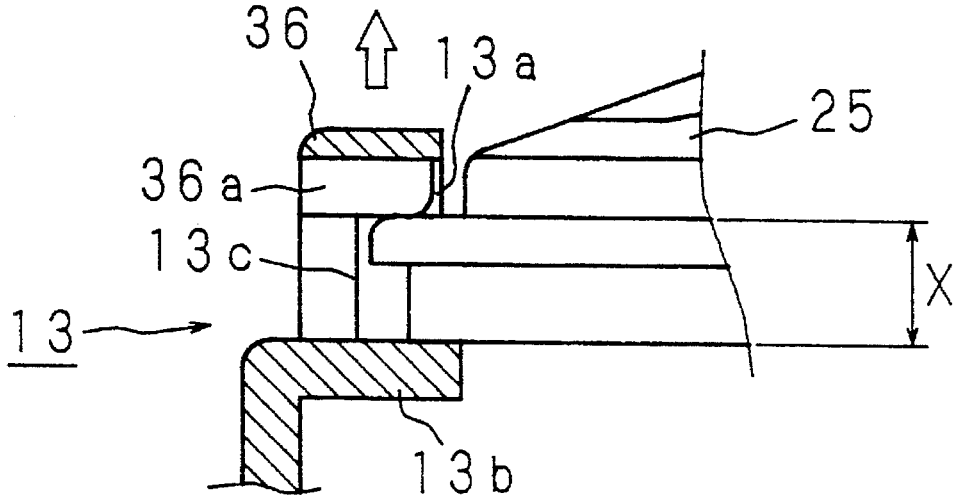
FIG. 41 is a flow chart illustrating the procedure subsequent to that of FIG. 40 for fixing the loudspeaker.

FIGS. 40 and 41 illustrate the procedure for fixing a loudspeaker having a flange height smaller than the width of the groove 10 on the fixing portion 13 of FIG. 36. As is shown in FIG. 40, when the flange 26 of the loudspeaker 25 having an arbitrary flange height X smaller than the width of the groove 10 is allowed to come in contact with the groove 10 in the fixing portion 13 and pushed into the groove 10, the elastic portions 36 are stretched upward like a bow in the direction shown with an arrow in the drawing because the ribs **36*a* are pressed outward by the flange 26. At this point, the flange 26 is applied with a force in the reverse direction of the arrow by the elastic portions 36, resulting in fixing the loudspeaker 25 on the fixing portion 13. In this manner, even the loudspeaker 25 having an arbitrary flange height smaller than the width of the groove 10 can be fixed on the fixing portion 13** with ease.

As described in detail above, the present invention requires a smaller number of components for fixing a loudspeaker and a shorter time of labor, resulting in improving the throughput of fixing loudspeakers, Further, since a mold to be used is applicable to the loudspeaker mounting apparatus in the open state with the hinge as a pivot, the designation and the production of the mold become easier and the cost for producing the mold can be decreased.

In addition, the loudspeaker mounting apparatus of the invention is easily applicable to fixing a plurality of loudspeakers thereon, and can largely decrease the time for the labor.

Further, since it is possible to close the space behind the loudspeaker, the sound quality can be improved without increasing the number of components.

Still more, since the loudspeaker mounting apparatus of the invention is applicable to fixing various types of loudspeakers having different flange heights thereon, it is possible to mount various types of loudspeakers by only one type of the loudspeaker mounting apparatus, resulting in such excellent effects as decreasing the cost for the components.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A loudspeaker mounting apparatus for mounting a loudspeaker at a position, comprising:

a pair of frame-parts each having a groove at inside thereof for fitting with a flange of said loudspeaker to be mounted, said groove being in the shape of an arc of a circle corresponding to said flange, wherein said frame-parts are hinged at one end and connectable with each other at the other end.

2. A loudspeaker mounting apparatus for mounting a loudspeaker at a position, comprising:

a pair of frame-parts, each of said frame-parts including a fixing portion having a groove at inside of said frame-parts for fitting with a flange of said loudspeaker to be mounted, said groove being in the shape of an arc of a circle corresponding to said flange, a first hinge for hinging said frame-parts at one end thereof, and a connecting portion for making said frame-parts connectable with each other at the other end thereof.

3. A loudspeaker mounting apparatus according to claim 2, wherein said fixing portion is formed in the plural numbers.

4. A loudspeaker mounting apparatus according to claim 2, wherein each of said frame-parts is closed at one end, and said fixing portion is positioned at a predetermined distance away from the closed end.

5. A loudspeaker mounting apparatus according to claim 2, wherein said fixing portion includes a plurality of second hinges each of which has a predetermined length and disposed at an edge of said groove, and wedges each of which is disposed at a tip of each of said second hinges and has an appropriate width.

6. A loudspeaker mounting apparatus according to claim 2, wherein said fixing portion includes a plurality of holes formed at a bottom of said groove, thinner portions formed at an edge of said groove with a thickness thereof corresponding to each of said holes being smaller than the other portions, and ribs disposed to project from said thinner portions in said groove inside and being adapted to come in contact with said flange of the loudspeaker.

7. A loudspeaker mounting apparatus for mounting a loudspeaker, comprising:

a first frame having a first groove for inserting a flange of a first loudspeaker; and a second frame having a second groove for inserting said flange of with said first loudspeaker;

a first hinge connecting a first end of said first frame with a first end of said second frame; and an engaging portion selectively connecting a second end of said first frame with a second end of said second frame to form a space defined by said first and second frames, wherein said first and second grooves hold said loudspeaker when said second ends of said first and second frames are engaged.

8. A loudspeaker mounting apparatus of claim 7, wherein shapes of said first and second grooves correspond to a shape of said flange of said first loudspeaker.

9. A loudspeaker mounting apparatus of claim 7, wherein said first frame includes a first receiving portion for receiving a second loudspeaker, and said second frame includes a second receiving portion for receiving said second loudspeaker.

10. A loudspeaker mounting apparatus of claim 7, wherein said engaging portion includes at least one protrusion protruding from one of said first and second frames, and at least one lock hole receiving said protrusion.

11. A loudspeaker mounting apparatus of claim 7, further comprising:

foldable arms extending from an edge of each of said grooves;

wedge portions formed at an end of each of said arms, said wedge portions selectively movable between a first position, outside said grooves for inserting said flange of said first speaker in said grooves, and a second position, inside said grooves, said wedge portions having a thickness smaller than the flange of said first loudspeaker by reducing a width of said grooves.

12. A loudspeaker mounting apparatus of claim 7, wherein said first and second grooves include a bottom wall and a pair of side walls extending from said bottom wall, said bottom wall includes a plurality of holes, one of said side walls has a plurality of thin portions at positions corresponding to said holes, and each of said thin portions has a rib projecting therefrom toward the other of said pair of side walls.

* * * * *